US008066084B2

(12) United States Patent
Dykstra et al.

(10) Patent No.: US 8,066,084 B2
(45) Date of Patent: Nov. 29, 2011

(54) DRILLING APPARATUS WITH REDUCED EXPOSURE OF CUTTERS AND METHODS OF DRILLING

(75) Inventors: Mark W. Dykstra, Kingwood, TX (US); William Heuser, The Woodlands, TX (US); Michael L. Doster, Spring, TX (US); Theodore E. Zaleski, Jr., Spring, TX (US); Jack T. Oldham, Willis, TX (US); Terry D. Watts, Spring, TX (US); Daniel E. Ruff, Kingwood, TX (US); Rodney B. Walzel, Conroe, TX (US); Christopher C. Beuershausen, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/906,713

(22) Filed: Oct. 18, 2010

(65) Prior Publication Data

US 2011/0114392 A1 May 19, 2011

Related U.S. Application Data

(63) Continuation of application No. 11/507,279, filed on Aug. 21, 2006, now Pat. No. 7,814,990, which is a continuation of application No. 11/214,524, filed on Aug. 30, 2005, now Pat. No. 7,096,978, which is a continuation of application No. 10/861,129, filed on Jun. 4, 2004, now Pat. No. 6,935,441, which is a continuation of application No. 10/266,534, filed on Oct. 7, 2002, now Pat. No. 6,779,613, which is a continuation of application No. 09/738,687, filed on Dec. 15, 2000, now Pat. No. 6,460,631, which is a continuation-in-part of application No. 09/383,228, filed on Aug. 26, 1999, now Pat. No. 6,298,930.

(51) Int. Cl.
*E21B 10/46* (2006.01)

(52) U.S. Cl. ..... 175/57; 175/428

(58) Field of Classification Search ..... 175/57, 175/363, 376, 378, 428, 429, 431, 432
See application file for complete search history.

(56) References Cited

U.S. PATENT DOCUMENTS 1,805,678 A 5/1931 Smith (Continued)

FOREIGN PATENT DOCUMENTS

EP 0 169 683 A2 1/1986

(Continued)

OTHER PUBLICATIONS

1995 Hughes Christensen Drill Bit Catalog, p. 31.

(Continued)

*Primary Examiner* — Daniel P Stephenson
(74) *Attorney, Agent, or Firm* — TraskBritt

(57) ABSTRACT

A rotary drilling apparatus and method for drilling subterranean formations, including a body being provided with at least one cutter thereon exhibiting reduced, or limited, exposure to the formation, so as to control the depth-of-cut of the at least one cutter, so as to control the volume of formation material cut per rotation of the drilling apparatus, as well as to control the amount of torque experienced by the drilling apparatus and an optionally associated bottomhole assembly regardless of the effective weight-on-bit are all disclosed. The exterior of the drilling apparatus may include a plurality of blade structures carrying at least one such cutter thereon and including a sufficient amount of bearing surface area to contact the formation so as to generally distribute an additional weight applied to the drilling apparatus against the bottom of the borehole without exceeding the compressive strength of the formation rock.

24 Claims, 22 Drawing Sheets

U.S. PATENT DOCUMENTS

| | | | | |
|---|---|---|---|---|
| 1,923,487 | A | 8/1933 | Howard | |
| 2,198,849 | A | 4/1940 | Waxier | |
| 2,563,515 | A | 8/1951 | Brown | |
| 2,624,549 | A | 1/1953 | Wallace | |
| 2,684,835 | A | 7/1954 | Moore | |
| 2,776,817 | A | 1/1957 | Gregory et al. | |
| 3,058,535 | A | 10/1962 | Williams | |
| 3,153,458 | A | 10/1964 | Short | |
| 3,303,894 | A | 2/1967 | Varney | |
| 3,308,896 | A | 3/1967 | Henderson | |
| 3,536,150 | A | 10/1970 | Stebley | |
| 3,709,308 | A | 1/1973 | Rowley et al. | |
| 3,779,323 | A | 12/1973 | Horten et al. | |
| 3,915,246 | A | 10/1975 | Sheshtawy | |
| 3,938,599 | A | 2/1976 | Horn | |
| 4,006,788 | A | 2/1977 | Garner | |
| 4,116,289 | A | 9/1978 | Feenstra | |
| 4,176,723 | A | 12/1979 | Arceneaux | |
| 4,253,533 | A | 3/1981 | Baker, III | |
| 4,351,401 | A | 9/1982 | Fielder | |
| 4,386,669 | A | 6/1983 | Evans | |
| 4,499,958 | A | 2/1985 | Radtke et al. | |
| 4,512,426 | A | 4/1985 | Bidegaray | |
| 4,554,986 | A | 11/1985 | Jones | |
| 4,718,505 | A | 1/1988 | Fuller | |
| 4,763,737 | A | 8/1988 | Hellnick | |
| 4,815,342 | A | 3/1989 | Brett et al. | |
| 4,889,017 | A | 12/1989 | Fuller et al. | |
| 4,932,484 | A | 6/1990 | Warren et al. | |
| 4,942,933 | A | 7/1990 | Barr et al. | |
| 4,981,184 | A | 1/1991 | Knowlton et al. | |
| 4,982,802 | A | 1/1991 | Warren et al. | |
| 4,991,670 | A | 2/1991 | Fuller et al. | |
| 5,010,789 | A | 4/1991 | Brett et al. | |
| 5,033,560 | A * | 7/1991 | Sawyer et al. | 175/431 |
| 5,042,596 | A | 8/1991 | Brett et al. | |
| 5,090,492 | A | 2/1992 | Keith | |
| 5,111,892 | A | 5/1992 | Sinor et al. | |
| 5,131,478 | A | 7/1992 | Brett et al. | |
| 5,199,511 | A | 4/1993 | Tibbitts et al. | |
| 5,222,566 | A | 6/1993 | Taylor et al. | |
| 5,244,039 | A * | 9/1993 | Newton et al. | 175/431 |
| 5,265,685 | A | 11/1993 | Keith et al. | |
| 5,303,785 | A | 4/1994 | Duke | |
| 5,314,033 | A | 5/1994 | Tibbitts | |
| 5,388,649 | A | 2/1995 | Ilomaki | |
| 5,402,856 | A | 4/1995 | Warren et al. | |
| 5,433,280 | A | 7/1995 | Smith | |
| 5,437,343 | A | 8/1995 | Cooley et al. | |
| 5,447,208 | A | 9/1995 | Lund et al. | |
| 5,505,273 | A | 4/1996 | Azar et al. | |
| 5,531,281 | A | 7/1996 | Murdock | |
| 5,544,550 | A | 8/1996 | Smith | |
| 5,549,171 | A | 8/1996 | Mensa-Wilmot et al. | |
| 5,558,170 | A | 9/1996 | Thigpen et al. | |
| 5,582,258 | A | 12/1996 | Tibbitts et al. | |
| 5,595,252 | A | 1/1997 | O'Hanlon | |
| 5,607,025 | A * | 3/1997 | Mensa-Wilmot et al. | 175/431 |
| 5,651,421 | A | 7/1997 | Newton et al. | |
| 5,653,300 | A | 8/1997 | Lund et al. | |
| 5,663,512 | A | 9/1997 | Schader et al. | |
| 5,720,357 | A | 2/1998 | Fuller et al. | |
| 5,730,234 | A | 3/1998 | Putot | |
| 5,738,178 | A | 4/1998 | Williams et al. | |
| 5,839,329 | A | 11/1998 | Smith et al. | |
| 5,873,422 | A | 2/1999 | Hansen et al. | |
| 5,937,958 | A * | 8/1999 | Mensa-Wilmot et al. | 175/398 |
| 5,957,006 | A | 9/1999 | Smith | |
| 5,979,576 | A | 11/1999 | Hansen et al. | |
| 6,073,518 | A | 6/2000 | Chow et al. | |
| 6,089,123 | A | 7/2000 | Chow et al. | |
| 6,123,161 | A * | 9/2000 | Taylor | 175/397 |
| 6,142,250 | A | 11/2000 | Griffin et al. | |
| 6,200,514 | B1 | 3/2001 | Meister | |
| 6,209,420 | B1 | 4/2001 | Butcher et al. | |
| 6,246,974 | B1 | 6/2001 | Jelley et al. | |
| 6,298,930 | B1 | 10/2001 | Sinor et al. | |
| 6,321,862 | B1 * | 11/2001 | Beuershausen et al. | 175/406 |
| 6,408,958 | B1 | 6/2002 | Isbell et al. | |
| 6,427,792 | B1 | 8/2002 | Roberts et al. | |
| 6,460,631 | B2 | 10/2002 | Dykstra et al. | |
| 6,568,492 | B2 | 5/2003 | Thigpen et al. | |
| 6,575,256 | B1 * | 6/2003 | Doster | 175/431 |
| 6,581,671 | B2 | 6/2003 | Butcher et al. | |
| 6,659,199 | B2 | 12/2003 | Swadi | |
| 6,779,613 | B2 | 8/2004 | Dykstra et al. | |
| 6,823,952 | B1 | 11/2004 | Mensa-Wilmot et al. | |
| 6,883,623 | B2 | 4/2005 | McCormick et al. | |
| 6,904,983 | B2 | 6/2005 | Thigpen et al. | |
| 6,935,441 | B2 | 8/2005 | Dykstra et al. | |
| 7,237,628 | B2 | 7/2007 | Desai et al. | |
| 7,360,608 | B2 | 4/2008 | Brackin et al. | |
| 7,395,882 | B2 | 7/2008 | Oldham et al. | |
| 7,413,032 | B2 | 8/2008 | Krueger | |
| 7,814,997 | B2 | 10/2010 | Aliko et al. | |
| 2001/0030065 | A1 | 10/2001 | Beuershausen et al. | |
| 2004/0244540 | A1 | 12/2004 | Oldham et al. | |
| 2004/0245022 | A1 | 12/2004 | Izaguirre et al. | |
| 2004/0245024 | A1 | 12/2004 | Kembaiyan | |
| 2005/0211475 | A1 | 9/2005 | Mirchandani et al. | |
| 2005/0230150 | A1 | 10/2005 | Oldham et al. | |
| 2007/0017710 | A1 | 1/2007 | Achilles et al. | |
| 2007/0151770 | A1 | 7/2007 | Ganz | |
| 2008/0308321 | A1 | 12/2008 | Aliko et al. | |
| 2010/0276200 | A1 | 11/2010 | Schwefe et al. | |

FOREIGN PATENT DOCUMENTS

| | | | |
|---|---|---|---|
| EP | 0 532 869 | B1 | 9/1997 |
| EP | 0 874 128 | A2 | 10/1998 |
| EP | 0 822 318 | B1 | 6/2002 |
| EP | 1 236 861 | A | 9/2002 |
| GB | 2 190 120 | B1 | 11/1987 |
| GB | 2 273 946 | A | 7/1994 |
| GB | 2 326 659 | A | 12/1998 |
| GB | 2 329 203 | A | 3/1999 |
| GB | 2 370 592 | A | 7/2002 |

OTHER PUBLICATIONS

Hughes Christensen Bit Drawing dated May 29, 1997—HC Part No. CC201918.

Hughes Christensen Bit Drawing dated Sep. 18, 1996—HC Part No. CW 210655.

Hughes Christensen Bit Drawing dated Sep. 18, 1996—HC Part No. CS205023.

Hughes Christensen Bit Drawing dated Sep. 9, 1996—HC Part No. CC201718.

Search Report of the UK Patent Office, dated Dec. 7, 2000, for Application No. GB0020134.3.

Search Report of the Belgian Patent Office, dated Aug. 14, 2001, for Application No. BE20000528.

Smith Diamond Drill Bit brochure, bit type M-21 IADC M646, 2 pages, circa 1990's.

Maurer, William C., Advanced Drilling Techniques, 1980, pp. 541 and 568, The Petroleum Publishing Company, Tulsa, Oklahoma.

Fabian, Robert T., Confined compressive strength analysis can improve PDC bit selection, Oil & Gas Journal, May 16, 1994, 5 pages.

Taylor, M.R., et al., High Penetration Rates and Extended Bit Life Through Revolutionary Hydraulic and Mechanical Design in PDC Drill Bit Development, SPE 36435, presented at the SPE Annual Technical Conference and Exhibition, held in Denver, Colorado, Oct. 6-9, 1996, 14 pages.

Spaar, J.R., et al., Formation Compressive Strength Estimates for Predicting Drillability and PDC Bit Selection, SPE/IADC 29397, presented at the SPE/IADC Drilling Conference held in Amsterdam, Feb. 29-Mar. 2, 1995.

Williams, J.L., et al., An Analysis of the Performance of PDC Hybrid Drill Bits, SPE/IADC 16117, presented at the SPE/IADC Drilling Conference, held in New Orleans, LA, on Mar. 15-18, 1987.

Drill Bit Developments, The Institution of Mechanical Engineers, Offshore Engineering Group, seminar held Apr. 26, 1989, in Aberdeen, Scotland.

Counterclaim-Defendants' Amended Invalidity Contentions Pursuant to Patent Rule 3-3, signed by James A. Jorgensen, Feb. 8, 2008, Filed in Civil Action No. 6:06-CV-222 (LED) in the United Stated District Court for the Eastern District of Texas, Tyler Division, 19 pages (nonmaterial portions redacted).
Christensen Diamond Compact Bit Manual, 1982, 89 pages.
Expert Report of Mark E. Nussbaum, Dated Jan. 7, 2008, Filed in Civil Action No. 6:06-CV-222 (LED) in the United Stated District Court for the Eastern District of Texas, Tyler Division, 57 pages (nonmaterial portions redacted).
Plaintiffs' First Amended Reply to Baker Hughes Oilfield Operations, Inc.'s and Baker Hughes, Inc.'s First Amended Answer and Counterclaims and Plaintiffs' Counterclaims for Declaratory Judgment of Patent Invalidity, Non-Infringement, and Unenforceability, Signed by J. Mike Amerson, dated Feb. 23, 2007, filed in Civil Action No. 6:06-CV-222 (LED) in the United Stated District Court for the Eastern District of Texas, Tyler Division, 11 pages (nonmaterial portions redacted).
Baker Hughes' Use of a Drill Bit Embodying the Alleged Inventions of the Asserted Claims of the 930 Patent Prior to Aug. 26, 1998, Expert Report of Mark Thompson, Jan. 18, 2008, Filed in Civil Action No. 6:06-CV-222 (LED) in the United Stated District Court for the Eastern District of Texas, Tyler Division, 5 pages (nonmaterial portions redacted).
DOCC bit—surface test, Memorandum from Wayne Hansen, dated May 11, 1998, 2 pages, Proprietary Material Subject to Protective Order—Document Filed Separately by Express Mail on Aug. 20, 2008, Pursuant to M.P.E.P. Section 724 With Petition Unde R 37 CFR Section 1.59.
Hansen, Wayne, Depth of Cut Control Feature Phase I 81/2" G554A2, May 1998, 35 pages, Proprietary Material Subject to Protective Order—Document Filed Separately by Express Mail on Aug. 20, 2008, Pursuant to M.P.E.P. Section 724 With Petition Unde R 37 CFR Section 1.59.
International Search Report for International Application No. PCT/US2008/066947, mailed Mar. 11, 2008, 4 pages.
International Search Report for International Application No. PCT/US2010/032370, mailed Jan. 3, 2011.
PCT International Search Report for PCT/US2006/047778 dated Jun. 4, 2007.
Stipulated Motion for Dismissal With Prejudice, United States District Court for the Easter District of Texas, Tyler Division, Civil Action No. 6:06-cv-222 (LED), dated Jun. 25, 2008.
Order RE Stipulated Motion for Dismissal With Prejudice, United States District Court for the Easter District of Texas, Tyler Division, Civil Action No. 6:06-cv-222 (LED), dated Jun. 26, 2008.

* cited by examiner

DRILLING APPARATUS WITH REDUCED EXPOSURE OF CUTTERS AND METHODS OF DRILLING

CROSS-REFERENCE TO RELATED APPLICATIONS

This application is a continuation of application Ser. No. 11/507,279, filed Aug. 21, 2006, now U.S. Pat. No. 7,814,990, issued Oct. 19, 2010, which is a continuation of application Ser. No. 11/214,524, filed Aug. 30, 2005, now U.S. Pat. No. 7,096,978, issued August 29, 2006, which is a continuation of application Ser. No. 10/861,129, filed Jun. 4, 2004, now U.S. Pat. No. 6,935,441, issued Aug. 30, 2005, which is a continuation of application Ser. No. 10/266,534, filed Oct. 7, 2002, now U.S. Pat. No. 6,779,613, issued Aug. 24, 2004, which is a continuation of application Ser. No. 09/738,687, filed Dec. 15, 2000, now U.S. Pat. No. 6,460,631, issued Oct. 8, 2002, which is a continuation-in-part of application Ser. No. 09/383,228, filed Aug. 26, 1999, now U.S. Pat. No. 6,298,930, issued Oct. 9, 2001, entitled Drill Bits with Controlled Cutter Loading and Depth of Cut, the disclosure of each of which of the foregoing patent applications and patents is hereby incorporated herein by this reference in its entirety.

BACKGROUND OF THE INVENTION

1. Field of the Invention

The present invention relates to rotary drag bits for drilling subterranean formations and their operation. More specifically, the present invention relates to the design of such bits for optimum performance in the context of controlling cutter loading and depth-of-cut without generating an excessive amount of torque-on-bit should the weight-on-bit be increased to a level which exceeds the optimal weight-on-bit for the current rate-of-penetration of the bit.

2. State of the Art

Rotary drag bits employing polycrystalline diamond compact (PDC) cutters have been employed for several decades. PDC cutters are typically comprised of a disc-shaped diamond "table" formed on and bonded under high-pressure and high-temperature conditions to a supporting substrate, such as cemented tungsten carbide (WC), although other configurations are known in the art. Bits carrying PDC cutters, which for example, may be brazed into pockets in the bit face, pockets in blades extending from the face, or mounted to studs inserted into the bit body, have proven very effective in achieving high rates of penetration (ROP) in drilling subterranean formations exhibiting low to medium compressive strengths. Recent improvements in the design of hydraulic flow regimes about the face of bits, cutter design, and drilling fluid formulation have reduced prior, notable tendencies of such bits to "ball" by increasing the volume of formation material which may be cut before exceeding the ability of the bit and its associated drilling fluid flow to clear the formation cuttings from the bit face.

Even in view of such improvements, however, PDC cutters still suffer from what might simply be termed "overloading" even at low weight-on-bit (WOB) applied to the drill string to which the bit carrying such cutters is mounted, especially if aggressive cutting structures are employed. The relationship of torque to WOB may be employed as an indicator of aggressivity for cutters, so the higher the torque to WOB ratio, the more aggressive the cutter. This problem is particularly significant in low compressive strength formations where an unduly great depth of cut (DOC) may be achieved at extremely low WOB. The problem may also be aggravated by drill string bounce, wherein the elasticity of the drill string may cause erratic application of WOB to the drill bit, with consequent overloading. Moreover, operating PDC cutters at an excessively high DOC may generate more formation cuttings than can be consistently cleared from the bit face and back up the bore hole via the junk slots on the face of the bit by even the aforementioned improved, state-of-the-art bit hydraulics, leading to the aforementioned bit balling phenomenon.

Another, separate problem involves drilling from a zone or stratum of higher formation compressive strength to a "softer" zone of lower strength. As the bit drills into the softer formation without changing the applied WOB (or before the WOB can be changed by the directional driller), the penetration of the PDC cutters, and thus the resulting torque on the bit (TOB), increase almost instantaneously and by a substantial magnitude. The abruptly higher torque, in turn, may cause damage to the cutters and/or the bit body itself. In directional drilling, such a change causes the tool face orientation of the directional (measuring-while-drilling, or MWD, or a steering tool) assembly to fluctuate, making it more difficult for the directional driller to follow the planned directional path for the bit. Thus, it may be necessary for the directional driller to back off the bit from the bottom of the borehole to reset or reorient the tool face. In addition, a downhole motor, such as drilling fluid-driven Moineau-type motors commonly employed in directional drilling operations in combination with a steerable bottomhole assembly, may completely stall under a sudden torque increase. That is, the bit may stop rotating, thereby stopping the drilling operation and again necessitating backing off the bit from the borehole bottom to re-establish drilling fluid flow and motor output. Such interruptions in the drilling of a well can be time consuming and quite costly.

Numerous attempts using various approaches have been made over the years to protect the integrity of diamond cutters and their mounting structures and to limit cutter penetration into a formation being drilled. For example, from a period even before the advent of commercial use of PDC cutters, U.S. Pat. No. 3,709,308 discloses the use of trailing, round natural diamonds on the bit body to limit the penetration of cubic diamonds employed to cut a formation. U.S. Pat. No. 4,351,401 discloses the use of surface set natural diamonds at or near the gage of the bit as penetration limiters to control the depth-of-cut of PDC cutters on the bit face. The following other patents disclose the use of a variety of structures immediately trailing PDC cutters (with respect to the intended direction of bit rotation) to protect the cutters or their mounting structures: U.S. Pat. Nos. 4,889,017; 4,991,670; 5,244,039 and 5,303,785. U.S. Pat. No. 5,314,033 discloses, inter alia, the use of cooperating positive and negative or neutral backrake cutters to limit penetration of the positive rake cutters into the formation. Another approach to limiting cutting element penetration is to employ structures or features on the bit body rotationally preceding (rather than trailing) PDC cutters, as disclosed in U.S. Pat. Nos. 3,153,458; 4,554,986; 5,199,511 and 5,595,252.

In another context, that of so-called "anti-whirl" drilling structures, it has been asserted in U.S. Pat. No. 5,402,856 to one of the inventors herein that a bearing surface aligned with a resultant radial force generated by an anti-whirl underreamer should be sized so that force per area applied to the borehole sidewall will not exceed the compressive strength of the formation being under-reamed. See also U.S. Pat. Nos. 4,982,802; 5,010,789; 5,042,596; 5,111,892 and 5,131,478.

While some of the foregoing patents recognize the desirability to limit cutter penetration, or DOC, or otherwise limit forces applied to a borehole surface, the disclosed approaches are somewhat generalized in nature and fail to accommodate or implement an engineered approach to achieving a target ROP in combination with more stable, predictable bit performance. Furthermore, the disclosed approaches do not provide a bit or method of drilling, which is generally tolerant to being axially loaded with an amount of weight-on-bit over and in excess of what would be optimum for the current rate-of-penetration for the particular formation being drilled and which would not generate high amounts of potentially bit-stopping or bit-damaging torque-on-bit, should the bit nonetheless be subjected to such excessive amounts of weight-on-bit.

BRIEF SUMMARY OF THE INVENTION

The present invention addresses the foregoing needs by providing a well-reasoned, easily implementable bit design particularly suitable for PDC cutter-bearing drag bits, which bit design may be tailored to specific formation compressive strengths or strength ranges to provide DOC control in terms of both maximum DOC and limitation of DOC variability. As a result, continuously achievable ROP may be optimized and torque controlled even under high WOB, while destructive loading of the PDC cutters is largely prevented.

The bit design of the present invention employs depth of cut control (DOCC) features, which reduce, or limit, the extent in which PDC cutters or other types of cutters or cutting elements are exposed on the bit face, on bladed structures, or as otherwise positioned on the bit. The DOCC features of the present invention provide substantial area on which the bit may ride while the PDC cutters of the bit are engaged with the formation to their design DOC, which may be defined as the distance the PDC cutters are effectively exposed below the DOCC features. Stated another way, the cutter standoff is substantially controlled by the effective amount of exposure of the cutters above the surface, or surfaces, surrounding each cutter. Thus, by constructing the bit so as to limit the exposure of at least some of the cutters on the bit, such limited exposure of the cutters in combination with the bit provides ample surface area to serve as a "bearing surface," in which the bit rides as the cutters engage the formation at their respective design DOC enables a relatively greater DOC (and thus ROP for a given bit rotational speed) than with a conventional bit design without the adverse consequences usually attendant thereto. Therefore the DOCC features of the present invention preclude a greater DOC than that designed for by distributing the load attributable to WOB over a sufficient surface area on the bit face, blades or other bit body structure contacting the formation face at the borehole bottom so that the compressive strength of the formation will not be exceeded by the DOCC features. As a result, the bit does not substantially indent, or fail, the formation rock.

Stated another way, the present invention limits the unit volume of formation material (rock) removed per bit rotation to prevent the bit from over-cutting the formation material and balling the bit or damaging the cutters. If the bit is employed in a directional drilling operation, tool face loss or motor stalling is also avoided.

In one embodiment, a rotary drag bit preferably includes a plurality of circumferentially spaced blade structures extending along the leading end or formation engaging portion of the bit generally from the cone region approximate the longitudinal axis, or centerline, of the bit, upwardly to the gage region, or maximum drill diameter of the bit. The bit further includes a plurality of superabrasive cutting elements, or cutters, such as PDC cutters, preferably disposed on radially outward facing surfaces of preferably each of the blade structures. In accordance with the DOCC aspect of the present invention, each cutter positioned in at least the cone region of the bit, e.g., those cutters, which are most radially proximate the longitudinal centerline and thus are generally positioned radially inward of a shoulder portion of the bit, are disposed in their respective blade structures in such a manner that each of such cutters is exposed only to a limited extent above the radially outwardly facing surface of the blade structures in which the cutters are associatively disposed. That is, each of such cutters exhibit a limited amount of exposure generally perpendicular to the selected portion of the formation-facing surface, in which the superabrasive cutter is secured to control the effective depth-of-cut of at least one superabrasive cutter into a formation when the bit is rotatingly engaging a formation, such as during drilling. By so limiting the amount of exposure of such cutters by, for example, the cutters being secured within and substantially encompassed by cutter-receiving pockets, or cavities, the DOC of such cutters into the formation is effectively and individually controlled. Thus, regardless of the amount of WOB placed or applied on the bit, even if the WOB exceeds what would be considered an optimum amount for the hardness of the formation being drilled and the ROP in which the drill bit is currently providing, the resulting torque, or TOB, will be controlled or modulated. Thus, because such cutters have a reduced amount of exposure above the respective formation-facing surface in which it is installed, especially as compared to prior art cutter installation arrangements, the resultant TOB generated by the bit will be limited to a maximum, acceptable value. This beneficial result is attributable to the DOCC features, or characteristics, of the present invention effectively preventing at least a sufficient number of the total number of cutters from over-engaging the formation and potentially causing the rotation of the bit to slow or stall due to an unacceptably high amount of torque being generated. Furthermore, the DOCC features of the present invention are essentially unaffected by excessive amounts of WOB, as there will preferably be a sufficient amount or size of bearing surface area devoid of cutters on at least the leading end of the bit in which the bit may "ride" upon the formation to inhibit or prevent a torque-induced bit stall from occurring.

Optionally, bits employing the DOCC aspects of the present invention may have reduced exposure cutters positioned radially more distant than those cutters proximate to the longitudinal centerline of the bit, such as in the cone region. To elaborate, cutters having reduced exposure may be positioned in other regions of a drill bit embodying the DOCC aspects of the present invention. For example, reduced exposure cutters positioned on the comparatively more radially distant nose, shoulder, flank, and gage portions of a drill bit will exhibit a limited amount of cutter exposure generally perpendicular to the selected portion of the radially outwardly facing surface to which each of the reduced exposure cutters are respectively secured. Thus, the surfaces carrying and proximately surrounding each of the additional reduced exposure cutters will be available to contribute to the total combined bearing surface area on which the bit will be able to ride upon the formation as the respective maximum depth-of-cut for each additional reduced exposure cutter is achieved depending upon the instant WOB and the hardness of the formation being drilled.

By providing DOCC features having a cumulative surface area sufficient to support a given WOB on a given rock formation, preferably without substantial indentation or failure of same, WOB may be dramatically increased, if desired, over that usable in drilling with conventional bits without the PDC cutters experiencing any additional effective WOB after the DOCC features are in full contact with the formation. Thus, the PDC cutters are protected from damage and, equally significant, the PDC cutters are prevented from engaging the formation to a greater depth of cut and consequently generating excessive torque may stall a motor or cause loss of tool face orientation.

The ability to dramatically increase WOB without adversely affecting the PDC cutters also permits the use of WOB substantially above and beyond the magnitude applicable without the adverse effects associated with conventional bits to maintain the bit in contact with the formation, reduce vibration and enhance the consistency and depth of cutter engagement with the formation. In addition, drill string, as well as dynamic axial effects, commonly termed "bounce" of the drill string under applied torque and WOB may be damped so as to maintain the design DOC for the PDC cutters. Again, in the context of directional drilling, this capability ensures maintenance of tool face and stall-free operation of an associated downhole motor driving the bit.

It is specifically contemplated that the DOCC features according to the present invention may be applied to coring bits as well as full bore drill bits. As used herein, the term "bit" encompasses core bits and other special purpose bits. Such usage may be, by way of example only, particularly beneficial when coring from a floating drilling rig, or platform, where WOB is difficult to control because of surface water wave-action-induced rig heave. When using the present invention, a WOB in excess of that normally required for coring may be applied to the drill string to keep the core bit on bottom and maintain core integrity and orientation.

It is also specifically contemplated that the DOCC attributes of the present invention have particular utility in controlling and specifically reducing torque required to rotate rotary drag bits as WOB is increased. While relative torque may be reduced in comparison to that required by conventional bits for a given WOB by employing the DOCC features at any radius or radii range from the bit centerline, variation in placement of DOCC features with respect to the bit centerline may be a useful technique for further limiting torque since the axial loading on the bit from applied WOB is more heavily emphasized toward the centerline and the frictional component of the torque is related to such axial loading. Accordingly, the present invention optionally includes providing a bit in which the extent of exposure of the cutters vary with respect to the cutters' respective positions on the face of the bit. As an example, one or more of the cutters positioned in the cone, or the region of the bit proximate the centerline of the bit, are exposed to a first extent, or amount, to provide a first DOC and one or more cutters positioned in the more radially distant nose and shoulder regions of the bit are exposed at a second extent, or amount, to provide a second DOC. Thus, a specifically engineered DOC profile may be incorporated into the design of a bit embodying the present invention to customize, or tailor, the bit's operational characteristics in order to achieve a maximum ROP while minimizing and/or modulating the TOB at the current WOB, even if the WOB is higher than what would otherwise be desired for the ROP and the specific hardness of the formation then being drilled.

Furthermore, bits embodying the present invention may include blade structures in which the extent of exposure of each cutter positioned on each blade structure has a particular and optionally individually unique DOC, as well as individually selected and possibly unique effective backrake angles, thus resulting in each blade of the bit having a preselected DOC cross-sectional profile as taken longitudinally parallel to the centerline of the bit and taken radially to the outermost gage portion of each blade. Moreover, a bit incorporating the DOCC features of the present invention need not have cutters installed on, or carried by, blade structures, as cutters having a limited amount of exposure perpendicular to the exterior of the bit in which each cutter is disposed, may be incorporated on regions of bits in which no blade structures are present. That is, bits incorporating the present invention may be completely devoid of blade structures entirely, such as, for example, a coring bit.

A method of constructing a drill bit in accordance with the present invention is additionally disclosed herein. The method includes providing at least a portion of the drill bit with at least one cutting element-accommodating pocket, or cavity, on a surface which will ultimately face and engage a formation upon the drill bit being placed in operation. The method of constructing a bit for drilling subterranean formations includes disposing within at least one cutter-receiving pocket a cutter exhibiting a limited amount of exposure perpendicular to the formation-facing surface proximate the cutter upon the cutter being secured therein. Optionally, the formation-facing surface may be built up by a hard facing, a weld, a weldment, or other material being disposed upon the surface surrounding the cutter so as to provide a bearing surface of a sufficient size while also limiting the amount of cutter exposure within a preselected range to effectively control the depth of cut that the cutter may achieve upon a certain WOB being exceeded and/or upon a formation of a particular compressive strength being encountered.

A yet further option is to provide wear knots, or structures, formed of a suitable material which extend outwardly and generally perpendicularly from the face of the bit in general proximity of at least one or more of the reduced exposure cutters. Such wear knots may be positioned rotationally behind, or trailing, each provided reduced exposure cutter so as to augment the DOCC aspects provided by the bearing surface respectively carrying and proximately surrounding a significant portion of each reduced exposure cutter. Thus, the optional wear knots, or wear bosses, provide a bearing surface area in which the drill bit may ride on the formation upon the maximum DOC of that cutter being obtained for the present formation hardness and then current WOB. Such wear knots, or bosses, may comprise hard facing material, structure provided when casting or molding the bit body or, in the case of steel-bodied bits, may comprise weldments, structures secured to the bit body by methods known within the art of subterranean drill bit construction, or by surface welds in the shape of one or more weld-beads or other configurations or geometries.

A method of drilling a subterranean formation is further disclosed. The method for drilling includes engaging a formation with at least one cutter and preferably a plurality of cutters in which one or more of the cutters each exhibit a limited amount of exposure perpendicular to a surface in which each cutter is secured. In one embodiment, several of the plurality of limited exposure cutters are positioned on a formation-facing surface of at least one portion, or region, of at least one blade structure, to render a cutter spacing and cutter exposure profile for that blade and preferably for a plurality of blades which will enable the bit to engage the formation within a wide range of WOB without generating an excessive amount of TOB, even at elevated WOBs, for the instant ROP in which the bit is providing. The method further includes an alternative embodiment in which the drilling is conducted with primarily only the reduced exposure cutters engaging a relatively hard formation within a selected range of WOB and upon a softer formation being encountered and/or an increased amount of WOB being applied, at least one bearing surface surrounding at least one reduced, or limited, exposure cutter, and preferably a plurality of sufficiently sized bearing surfaces respectively surrounding a plurality of reduced exposure cutters, contacts the formation and thus limits the DOC of each reduced, or limited, exposure cutter while allowing the bit to ride on the bearing surface, or bearing surfaces, against the formation regardless of the WOB being applied to the bit and without generating an unacceptably high, potentially bit damaging TOB for the current ROP.

DETAILED DESCRIPTION OF THE INVENTION

Figure 1:
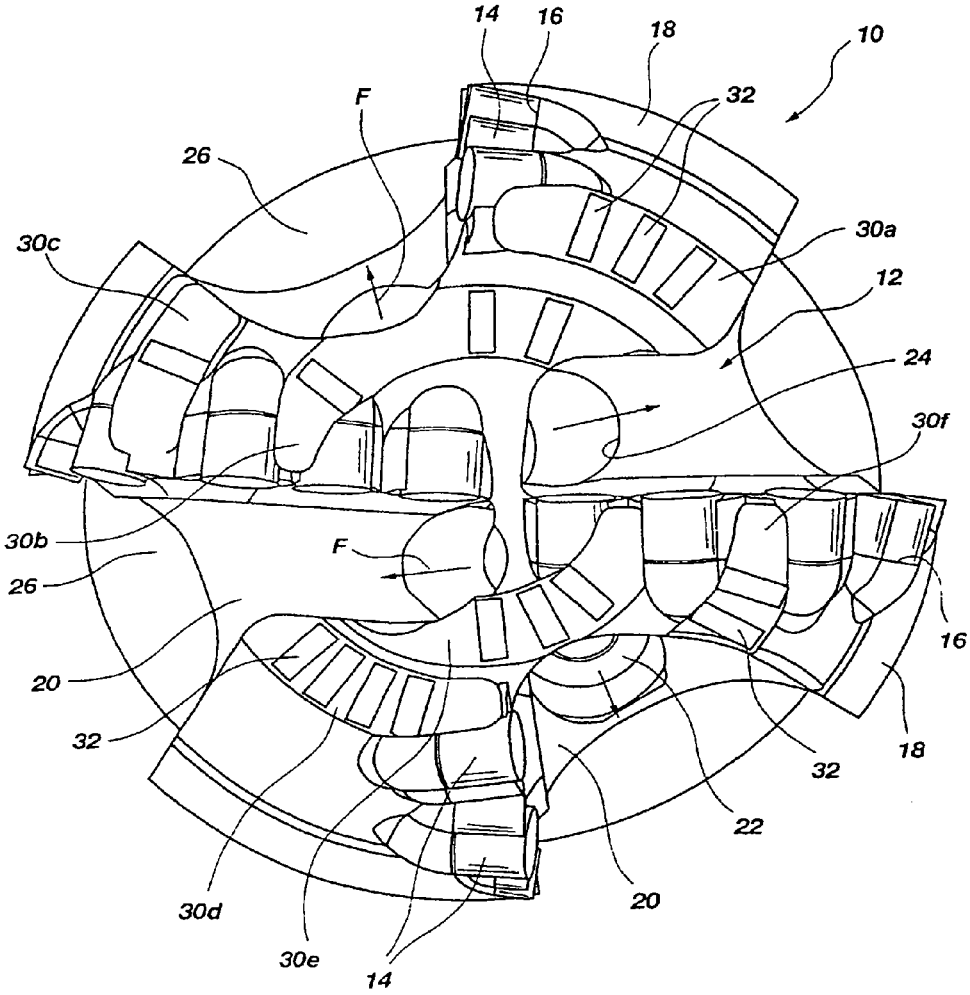
FIG. 1 is a bottom elevation looking upward at the face of one embodiment of a drill bit including the DOCC features according to the invention.

FIG. 1 of the drawings depicts a rotary drag bit 10 looking upwardly at its face or leading end 12 as if the viewer were positioned at the bottom of a borehole. Bit 10 includes a plurality of PDC cutters 14 bonded by their substrates (diamond tables and substrates not shown separately for clarity), as by brazing, into pockets 16 in blades 18 extending above the face 12, as is known in the art with respect to the fabrication of so-called "matrix" type bits. Such bits include a mass of metal powder, such as tungsten carbide, infiltrated with a molten, subsequently hardenable binder, such as a copper-based alloy. It should be understood, however, that the present invention is not limited to matrix-type bits, and that steel body bits and bits of other manufacture may also be configured according to the present invention.

Figure 2:
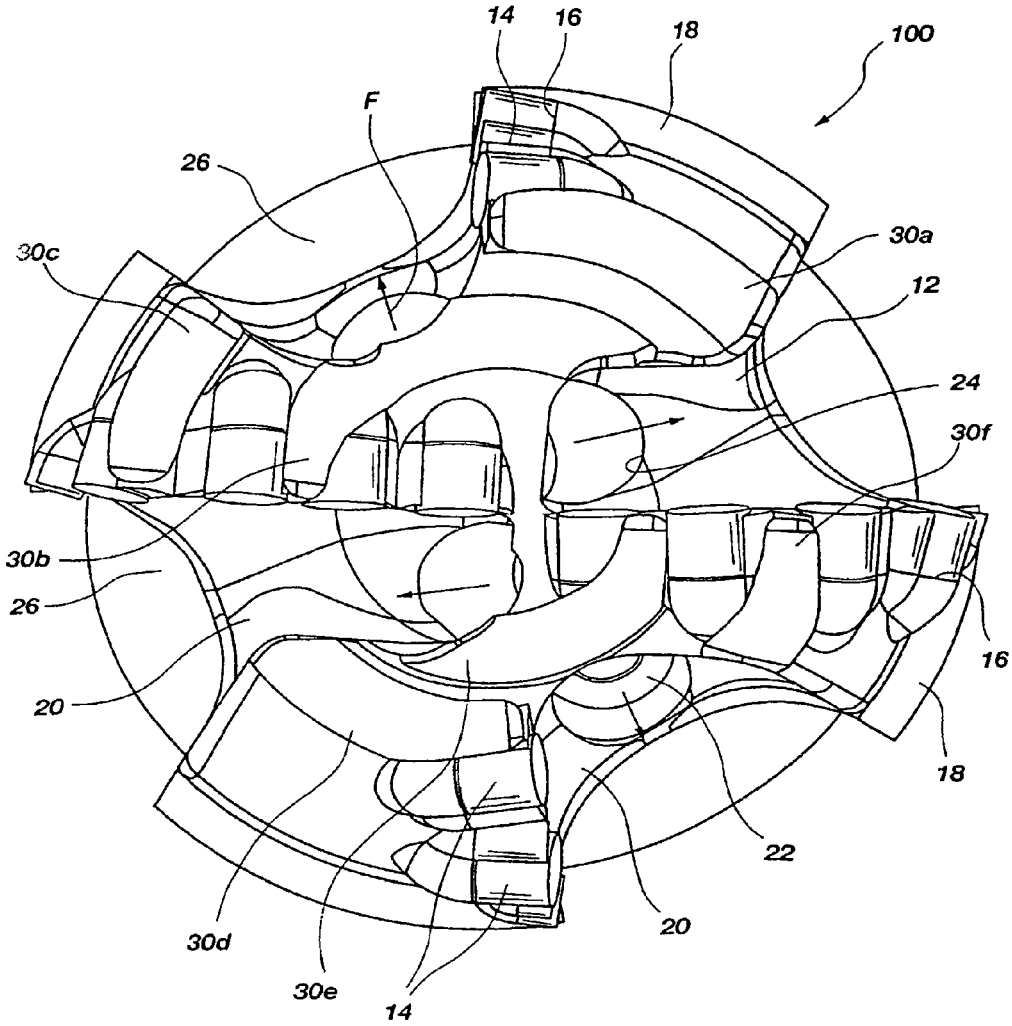
FIG. 2 is a bottom elevation looking upward at the face of another embodiment of a drill bit including the DOCC features according to the invention.
Figure 2A:
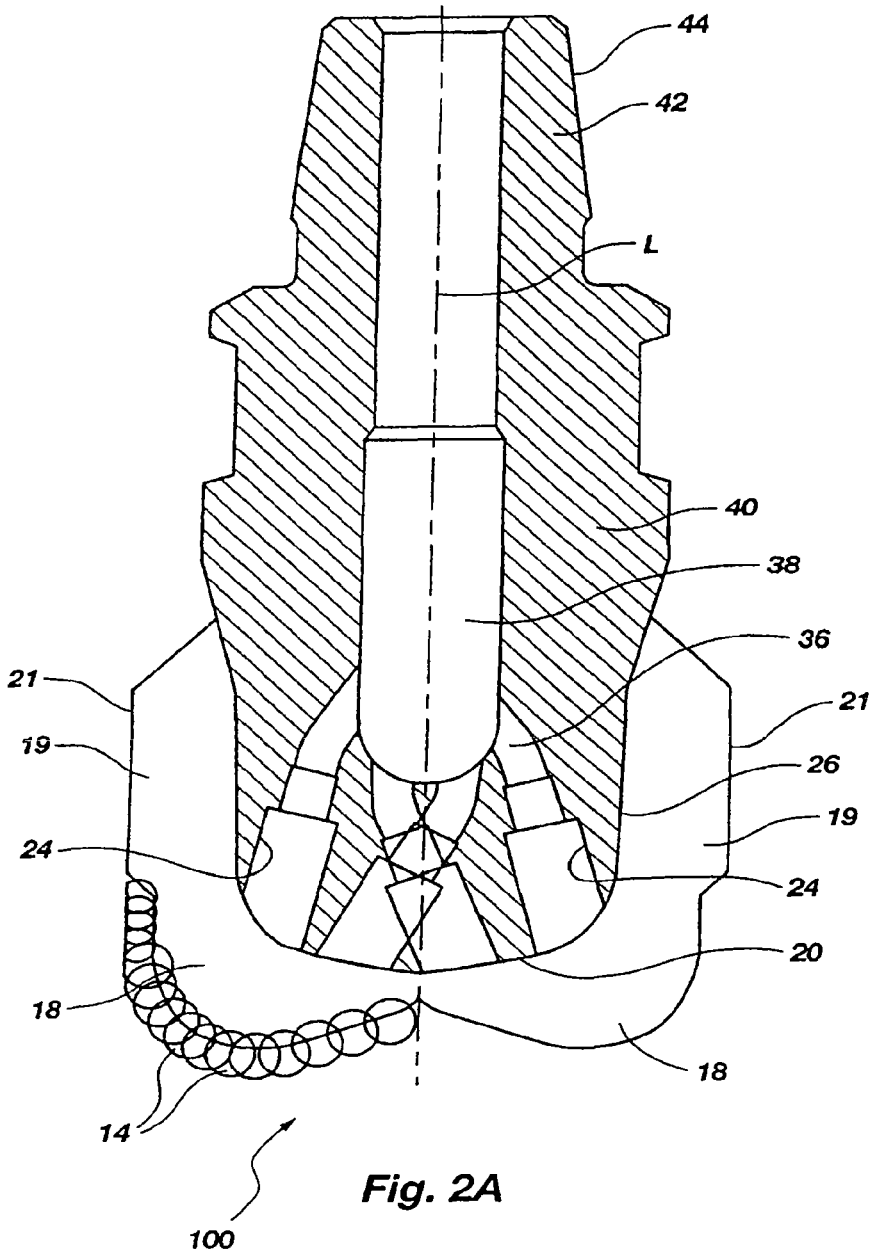
FIG. 2A is a side sectional elevation of the profile of the drill bit of FIG. 2.

Fluid courses 20 lie between blades 18 and are provided with drilling fluid by nozzles 22 secured in nozzle orifices 24, orifices 24 being at the end of passages leading from a plenum extending into the bit body from a tubular shank at the upper, or trailing, end of the bit (see FIG. 2A in conjunction with the accompanying text for a description of these features). Fluid courses 20 extend to junk slots 26 extending upwardly along the side of bit 10 between blades 18. Gage pads 19 comprise longitudinally upward extensions of blades 18 and may have wear-resistant inserts or coatings on radially outer surfaces 21 thereof as known in the art. Formation cuttings are swept away from PDC cutters 14 by drilling fluid F emanating from nozzle orifices 24, the drilling fluid F moving generally radially outwardly through fluid courses 20 and then upwardly through junk slots 26 to an annulus between the drill string from which the bit 10 is suspended and on to the surface.

Referring again to FIG. 1, a plurality of the DOCC features, each comprising an arcuate bearing segment 30*a* through 30*f*, reside on, and in some instances bridge between, blades 18. Specifically, bearing segments 30*b* and 30*e* each reside partially on an adjacent blade 18 and extend therebetween. The arcuate bearing segments 30*a* through 30*f*, each of which lies along substantially the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not indent or fail and the penetration of PDC cutters 14 into the rock is substantially controlled. As can be seen in FIG. 1, wear-resistant elements or inserts 32, in the form of tungsten carbide bricks or discs, diamond grit, diamond film, natural or synthetic diamond (PDC or TSP), or cubic boron nitride, may be added to the exterior bearing surfaces of bearing segments 30 to reduce the abrasive wear thereof by contact with the formation under WOB as the bit 10 rotates under applied torque. In lieu of inserts, the bearing surfaces may be comprised of, or completely covered with, a wear-resistant material. The significance of wear characteristics of the DOCC features will be explained in more detail below.

FIGS. 2 and 2A depict another embodiment of a rotary drill bit 100 according to the present invention. For clarity, features and elements in FIGS. 2 and 2A corresponding to those identified with respect to bit 10 of FIG. 1 are identified with the same reference numerals. FIG. 2 depicts a rotary drill bit 100 looking upwardly at its face 12 as if the viewer were positioned at the bottom of a borehole. Bit 100 also includes a plurality of PDC cutters 14 bonded by their substrates (diamond tables and substrates not shown separately for clarity), as by brazing, into pockets 16 in blades 18 extending above the face 12 of bit 100.

Fluid courses 20 lie between blades 18 and are provided with drilling fluid F by nozzles 22 secured in nozzle orifices 24, orifices 24 being at the end of passages 36 leading from a plenum 38 extending into bit body 40 from a tubular shank 42 threaded (not shown) on its exterior surface 44 as known in the art at the upper end of the bit 100 (see FIG. 2A). Fluid courses 20 extend to junk slots 26 extending upwardly along the side of bit 10 between blades 18. Gage pads 19 comprise longitudinally upward extensions of blades 18 and may have wear-resistant inserts or coatings on radially outer surfaces 21 thereof as known in the art.

Referring again to FIG. 2, a plurality of the DOCC features, each comprising an arcuate bearing segment 30*a* through 30*f*, reside on, and in some instances bridge between, blades 18. Specifically, bearings 30*b* and 30*e* each reside partially on an adjacent blade 18 and extend therebetween. The arcuate bearing segments 30*a* through 30*f*, each of which lies substantially along the same radius from the bit centerline as a PDC cutter 14 rotationally trailing that bearing segment 30, together provide sufficient surface area to withstand the axial or longitudinal WOB without exceeding the compressive strength of the formation being drilled, so that the rock does not unduly indent or fail and the penetration of PDC cutters 14 into the rock is substantially controlled.

By way of example only, the total DOCC features surface area for an 8.5 inch diameter bit generally configured as shown in FIGS. 1 and 2 may be about 12 square inches. If, for example, the unconfined compressive strength of a relatively soft formation to be drilled by either bit 10 or 100 is 2,000 pounds per square inch (psi), then at least about 24,000 lbs. WOB may be applied without failing or indenting the formation. Such WOB is far in excess of the WOB which may normally be applied to a bit in such formations (for example, as little as 1,000 to 3,000 lbs., up to about 5,000 lbs.) without incurring bit balling from excessive DOC and the consequent cuttings volume which overwhelms the bit's hydraulic ability to clear them. In harder formations, with, for example, 20,000 to 40,000 psi compressive strengths, the total DOCC features surface area may be significantly reduced while still accommodating substantial WOB applied to keep the bit firmly on the borehole bottom. When older, less sophisticated, drill rigs are employed or during directional drilling, both of which render it difficult to control WOB with any substantial precision, the ability to overload WOB without adverse consequences further distinguishes the superior performance of bits embodying the present invention. It should be noted at this juncture that the use of an unconfined compressive strength of formation rock provides a significant margin for calculation of the required bearing area of the DOCC features for a bit, as the in situ, confined, compressive strength of a subterranean formation being drilled is substantially higher. Thus, if desired, confined compressive strength values of selected formations may be employed in designing the total DOCC features as well as the total bearing area of a bit to yield a smaller required area, but which still advisedly provides for an adequate "margin" of excess bearing area in recognition of variations in continued compressive strengths of the formation to preclude substantial indentation and failure of the formation downhole.

Figure 13A:
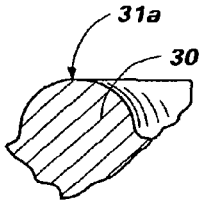
FIGS. 13A-13C are transverse sections of various cross-sectional configurations for the DOCC features according to the invention.
Figure 13B:
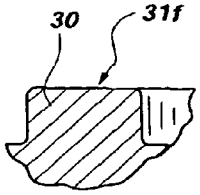
Figure 13C:
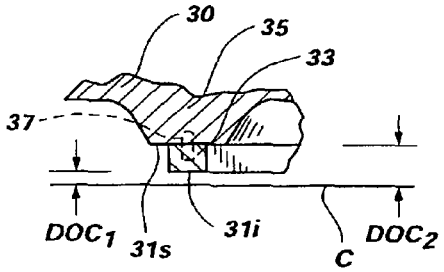

While bit 100 is notably similar to bit 10, the viewer will recognize and appreciate that wear inserts 32 are omitted from bearing segments 30*a* through 30*f* on bit 100, such an arrangement being suitable for less abrasive formations where wear is of lesser concern and the tungsten carbide of the bit matrix (or applied hard facing in the case of a steel body bit) is sufficient to resist abrasive wear for a desired life of the bit. As shown in FIG. 13A, the DOCC features (bearing segments 30) of either bit 10 or bit 100, or of any bit according to the invention, may be of arcuate cross-section, taken transverse to the arc followed as the bit rotates, to provide an arcuate bearing surface 31 a mimicking the cutting edge arc of an unworn, associated PDC cutter following a DOCC feature. Alternatively, as shown in FIG. 13B, a DOCC feature (bearing segment 30) may exhibit a flat bearing surface 31f to the formation, or may be otherwise configured. It is also contemplated, as shown in FIG. 13C, that a DOCC feature (bearing segment 30) may be cross-sectionally configured and comprised of a material so as to intentionally and relatively quickly (in comparison to the wear rate of a PDC cutter) wear from a smaller initial bearing surface 31*i* providing a relatively small $DOC_1$ with respect to the point or line of contact C with the formation traveled by the cutting edge of a trailing, associated PDC cutter while drilling a first, hard formation interval to a larger, secondary bearing surface 31*s*, which also provides a much smaller $DOC_2$ for a second, lower, much softer (and lower compressive strength) formation interval. Alternatively, the head 33 of the DOCC structure (bearing segment 30) may be made controllably shearable from the base 35 (as with frangible connections like a shear pin, one shear pin 37 shown in broken lines).

For reference purposes, bits 10 and 100, as illustrated, may be said to be symmetrical or concentric about their centerlines or longitudinal axes L, although this is not necessarily a requirement of the invention.

Both bits 10 and 100 are unconventional in comparison to state of the art bits in that PDC cutters 14 on bits 10 and 100 are disposed at far lesser backrakes, in the range of for example, 7° to 15° with respect to the intended direction of rotation generally perpendicular to the surface of the formation being engaged. In comparison, many conventional bits are equipped with cutters at a 30° backrake and a 20° backrake is regarded as somewhat "aggressive" in the art. The presence of the DOCC feature permits the use of substantially more aggressive backrakes, as the DOCC features preclude the aggressively raked PDC cutters from penetrating the formation to too great a depth, as would be the case in a bit without the DOCC features.

In the cases of both bit 10 and bit 100, the rotationally leading DOCC features (bearing segments 30) are configured and placed to substantially exactly match the pattern drilled in the bottom of the borehole when drilling at an ROP of 100 feet per hour (fph) at 120 rotations per minute (rpm) of the bit. This results in a DOC of about 0.166 inch per revolution. Due to the presence of the DOCC features (bearing segments 30), after sufficient WOB has been applied to drill 100 fph, any additional WOB is transferred from the bit body 40 of the bit 10 or 100 through the DOCC features to the formation. Thus, the PDC cutters 14 are not exposed to any substantial additional weight, unless and until a WOB sufficient to fail the formation being drilled would be applied, which application may be substantially controlled by the driller, since the DOCC features may be engineered to provide a large margin of error with respect to any given sequence of formations which might be encountered when drilling an interval.

As a further consequence of the present invention, the DOCC features would, as noted above, preclude PDC cutters 14 from excessively penetrating or "gouging" the formation, a major advantage when drilling with a downhole motor where it is often difficult to control WOB and WOB inducing, such excessive penetration can result in the motor stalling, with consequent loss of tool face and possible damage to motor components, as well as to the bit itself. While the addition of WOB beyond that required to achieve the desired ROP will require additional torque to rotate the bit due to frictional resistance to rotation of the DOCC features over the formation, such additional torque is a lesser component of the overall torque.

Figure 3:
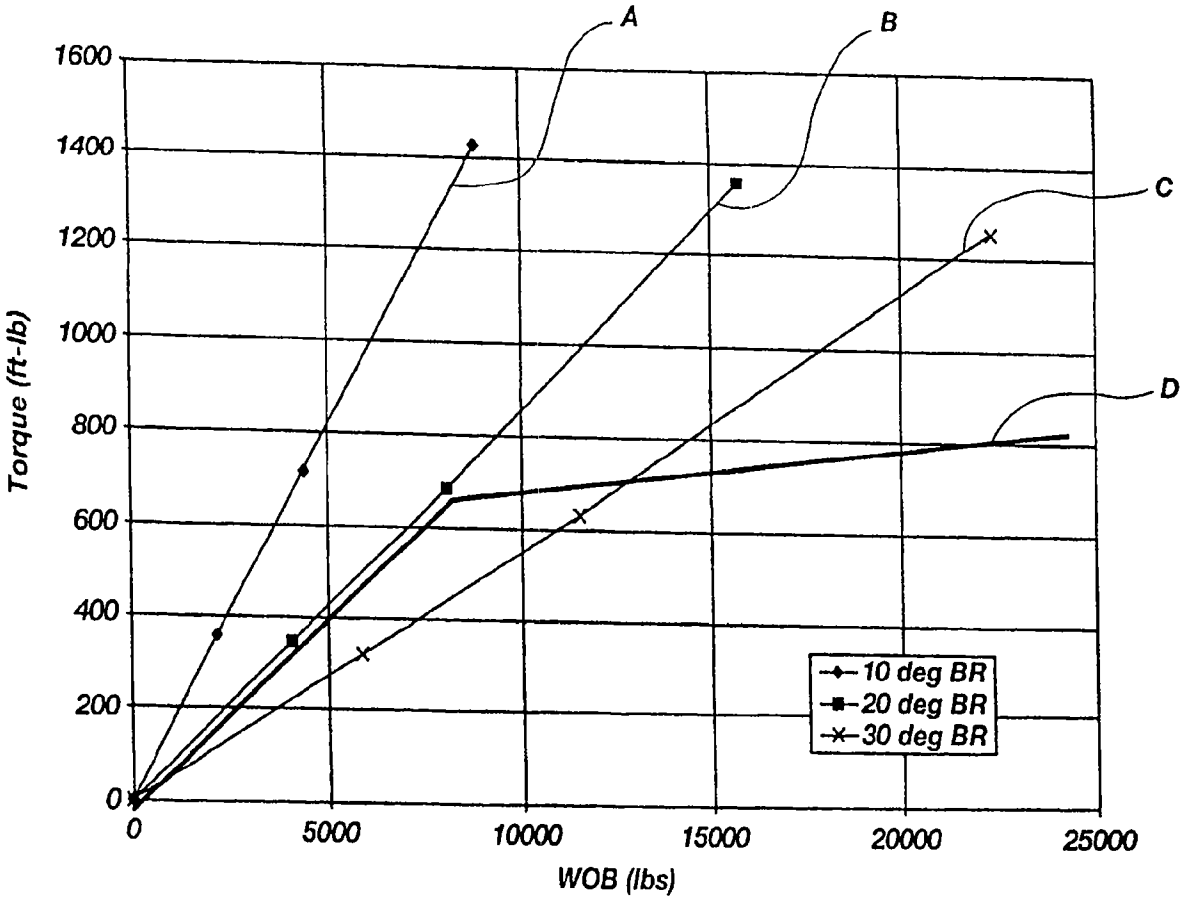
FIG. 3 is a graph depicting mathematically predicted torque versus WOB for conventional bit designs employing cutters at different backrakes versus a similar bit according to the present invention.

The benefit of DOCC features in controlling torque can readily be appreciated by a review of FIG. 3 of the drawings, which is a mathematical model of performance of a 3¾ inch diameter, four-bladed, Hughes Christensen R324XL PDC bit showing various torque versus WOB curves for varying cutter backrakes in drilling Mancos shale. Curve A represents the bit with a 10° cutter backrake, curve B, the bit with a 20° cutter backrake, curve C, the bit with a 30° cutter backrake, and curve D, the bit using cutters disposed at a 20° backrake and including the DOCC features according to the present invention. The model assumes a bit design according to the invention for an ROP of 50 fph at 100 rpm, which provides 0.1 inch per revolution penetration of a formation being drilled. As can readily be seen, regardless of cutter backrake, curves A through C clearly indicate that, absent the DOCC features according to the present invention, required torque on the bit continues to increase continuously and substantially linearly with applied WOB, regardless of how much WOB is applied. On the other hand, curve D indicates that, after WOB approaches about 8,000 lbs. on the bit, including the DOCC features, the torque curve flattens significantly and increases in a substantially linear manner only slightly from about 670 ft-lb. to just over 800 ft-lb. even as WOB approaches 25,000 lbs. As noted above, this relatively small increase in the torque after the DOCC features engage the formation is frictionally related, and is also somewhat predictable. As graphically depicted in FIG. 3, this additional torque load increases substantially linearly as a function of WOB times the coefficient of friction between the bit and the formation.

Figure 4:
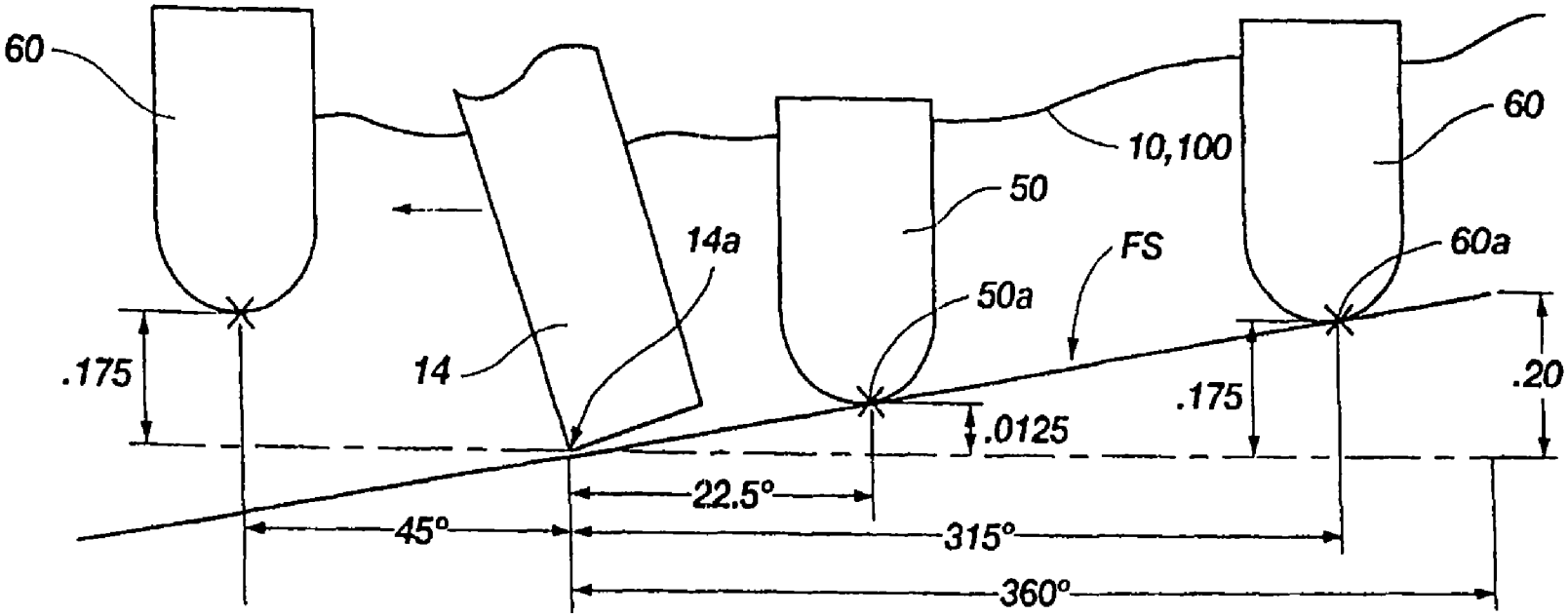
FIG. 4 is a schematic side elevation, not to scale, comparing prior art placement of a depth-of-cut limiting structure closely behind a cutter at the same radius, taken along a 360° rotational path, versus placement according to the present invention preceding the cutter and at the same radius.

Referring now to FIG. 4 (which is not to scale) of the drawings, a further appreciation of the operation and benefits of the DOCC features according to the present invention may be obtained. Assuming a bit designed for an ROP of 120 fph at 120 rpm, this requires an average DOC of 0.20 inch. The DOCC features or DOC limiters would thus be designed to first contact the subterranean formation surface FS to provide a 0.20 inch DOC. It is assumed for the purposes of FIG. 4 that DOCC features or DOC limiters are sized so that compressive strength of the formation being drilled is not exceeded under applied WOB. As noted previously, the compressive strength of concern would typically be the in situ compressive strength of the formation rock resident in the formation being drilled (plus some safety factor), rather than unconfined compressive strength of a rock sample. In FIG. 4, an exemplary PDC cutter 14 is shown, for convenience, moving linearly right to left on the page. One complete revolution of the bit 10 or 100 on which PDC cutter 14 is mounted has been "unscrolled" and laid out flat in FIG. 4. Thus, as shown, PDC cutter 14 has progressed downwardly (i.e., along the longitudinal axis of the bit 10 or 100 on which it is mounted) 0.20 inch in 360° of rotation of the bit 10 or 100. As shown in FIG. 4, a structure or element to be used as a DOC limiter 50 is located conventionally, closely rotationally "behind" PDC cutter 14, as only 22.5° behind PDC cutter 14, the outermost tip 50*a* must be recessed upwardly 0.0125 inch (0.20 inch DOC H 22.5°/360°) from the outermost tip 14*a* of PDC cutter 14 to achieve an initial 0.20 inch DOC. However, when DOC limiter 50 wears during drilling, for example, by a mere 0.010 inch relative to the tip 14*a* of PDC cutter 14, the vertical offset distance between the tip 50*a* of DOC limiter 50 and tip 14*a* of PDC cutter 14 is increased to 0.0225 inch. Thus, DOC will be substantially increased, in fact, almost doubled, to 0.36 inch. Potential ROP would consequently equal 216 fph due to the increase in vertical standoff provided to PDC cutter 14 by worn DOC limiter 50, but the DOC increase may damage PDC cutter 14 or ball the bit 10 or 100 by generating a volume of formation cuttings which overwhelms the bit's ability to clear them hydraulically. Similarly, if PDC cutter tip 14*a* wore at a relatively faster rate than DOC limiter 50 by, for example, 0.010 inch, the vertical offset distance is decreased to 0.0025 inch, DOC is reduced to 0.04 inch and ROP to 24 fph. Thus, excessive wear or vertical misplacement of either PDC cutter 14 or DOC limiter 50 to the other may result in a wide range of possible ROPs for a given rotational speed. On the other hand, if an exemplary DOCC feature 60 is placed, according to the present invention, 45° rotationally in front of (or 315° rotationally behind) PDC cutter tip 14*a*, the outermost tip 60*a* would initially be recessed upwardly 0.175 inch (0.20 inch DOC H 315°/360°) relative to PDC cutter tip 14*a* to provide the initial 0.20 inch DOC. FIG. 4 shows the same DOCC feature 60 twice, both rotationally in front of and behind PDC cutter 14, for clarity, it being, of course, understood that the path of PDC cutter 14 is circular throughout a 360° arc in accordance with rotation of bit 10 or 100. When DOCC feature 60 wears 0.010 inch relative to PDC cutter tip 14*a*, the vertical offset distance between tip 60*a* of DOCC feature 60 and tip 14*a* of PDC cutter 14 is only increased from 0.175 inch to 0.185 inch. However, due to the placement of DOCC feature 60 relative to PDC cutter 14, DOC will be only slightly increased to about 0.211 inch. As a consequence, ROP would only increase to about 127 fph. Likewise, if PDC cutter 14 wears 0.010 inch relative to DOCC feature 60, vertical offset of DOCC feature 60 is only reduced to 0.165 inch and DOC is only reduced to about 0.189 inch, with an attendant ROP of about 113 fph. Thus, it can readily be seen how rotational placement of a DOCC feature can significantly affect ROP as the limiter or the cutter wears with respect to the other, or if one such component has been misplaced or incorrectly sized to protrude incorrectly even slightly upwardly or downwardly of its ideal, or "design," position relative to the other, associated component when the bit is fabricated. Similarly, mismatches in wear between a cutter and a cutter-trailing DOC limiter are magnified in the prior art, while being significantly reduced when DOCC features are sized and placed in cutter-leading positions according to the present invention are employed. Further, if a DOC limiter trailing, rather than leading, a given cutter is employed, it will be appreciated that shock or impact loading of the cutter is more probable as, by the time the DOC limiter contacts the formation, the cutter tip will have already contacted the formation. Leading DOCC features on the other hand, by being located in advance of a given cutter along the downward helical path, the cutter travels as it cuts the formation and the bit advances along its longitudinal axis, tend to engage the formation before the cutter. The terms "leading" and "trailing" the cutter may be easily understood as being preferably respectively associated with DOCC features positioned up to 180° rotationally preceding a cutter versus DOCC features positioned up to 180° rotationally trailing a cutter. While some portion of, for example, an elongated, arcuate leading DOCC feature according to the present invention may extend so far rotationally forward of an associated cutter so as to approach a trailing position, the substantial majority of the arcuate length of such a DOCC feature would preferably reside in a leading position. As may be appreciated by further reference to FIGS. 1 and 2, there may be a significant rotational spacing between a PDC cutter 14 and an associated bearing segment 30 of a DOCC feature, as across a fluid course 20 and its associated junk slot 26, while still rotationally leading the PDC cutter 14. More preferably, at least some portion of a DOCC feature according to the invention will lie within about 90° rotationally preceding the face of an associated cutter.

One might question why limitation of ROP would be desirable, as bits according to the present invention using DOCC features may not, in fact, drill at as great an ROP as conventional bits not so equipped. However, as noted above, by using DOCC features to achieve a predictable and substantially sustainable DOC in conjunction with a known ability of a bit's hydraulics to clear formation cuttings from the bit at a given maximum volumetric rate, a sustainable (rather than only peak) maximum ROP may be achieved without the bit balling and with reduced cutter wear and substantial elimination of cutter damage and breakage from excessive DOC, as well as impact-induced damage and breakage. Motor stalling and loss of tool face may also be eliminated. In soft or ultra-soft formations very susceptible to balling, limiting the unit volume of rock removed from the formation per unit time prevents a bit from "over cutting" the formation. In harder formations, the ability to apply additional WOB in excess of what is needed to achieve a design DOC for the bit may be used to suppress unwanted vibration normally induced by the PDC cutters and their cutting action, as well as unwanted drill string vibration in the form of bounce, manifested on the bit by an excessive DOC. In such harder formations, the DOCC features may also be characterized as "load arresters" used in conjunction with "excess" WOB to protect the PDC cutters from vibration-induced damage, the DOCC features again being sized so that the compressive strength of the formation is not exceeded. In harder formations, the ability to damp out vibrations and bounce by maintaining the bit in constant contact with the formation is highly beneficial in terms of bit stability and longevity, while in steerable applications the invention precludes loss of tool face.

Figure 5:
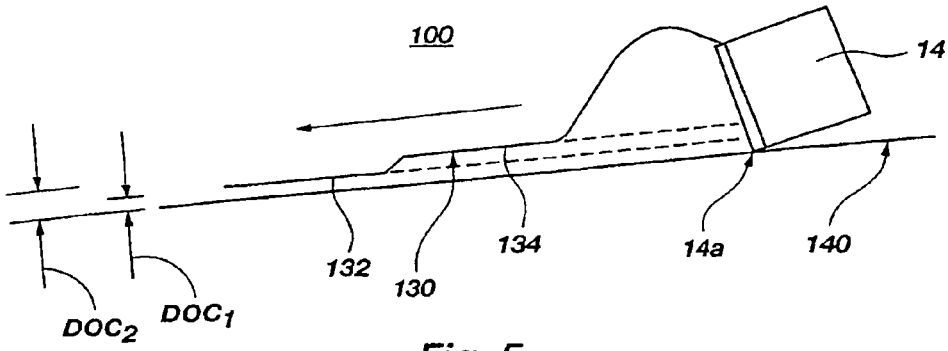
FIG. 5 is a schematic side elevation of a two-step DOCC feature and associated trailing PDC cutter.

FIG. 5 depicts one exemplary variation of a DOCC feature according to the present invention, which may be termed a "stepped" DOCC feature 130 comprising an elongated, arcuate bearing segment. Such a configuration, shown for purposes of illustration preceding a PDC cutter 14 on a bit 100 (by way of example only), includes a lower, rotationally leading first step 132 and a higher, rotationally trailing second step 134. As tip 14*a* of PDC cutter 14 follows its downward helical path generally indicated by line 140 (the path, as with FIG. 4, being unscrolled on the page), the surface area of first step 132 may be used to limit DOC in a harder formation with a greater compressive strength, the bit "riding" high on the formation with PDC cutter 14 taking a minimal $DOC_1$ in the formation surface, shown by the lower dashed line. However, as bit 100 enters a much softer formation with a far lesser compressive strength, the surface area of first step 132 will be insufficient to prevent indentation and failure of the formation, and so first step 132 will indent the formation until the surface of second step 134 encounters the formation material, increasing DOC by PDC cutter 14. At that point, the total surface area of first and second steps 132 and 134 (in combination with other first and second steps respectively associated with other PDC cutters 14) will be sufficient to prevent further indentation of the formation and the deeper $DOC_2$ in the surface of the softer formation (shown by the upper dashed line) will be maintained until the bit 100 once again encounters a harder formation. When this occurs, the bit 100 will ride up on the first step 132, which will take any impact from the encounter before PDC cutter 14 encounters the formation, and the DOC will be reduced to its previous DOC level, avoiding excessive torque and motor stalling.

Figure 6A:
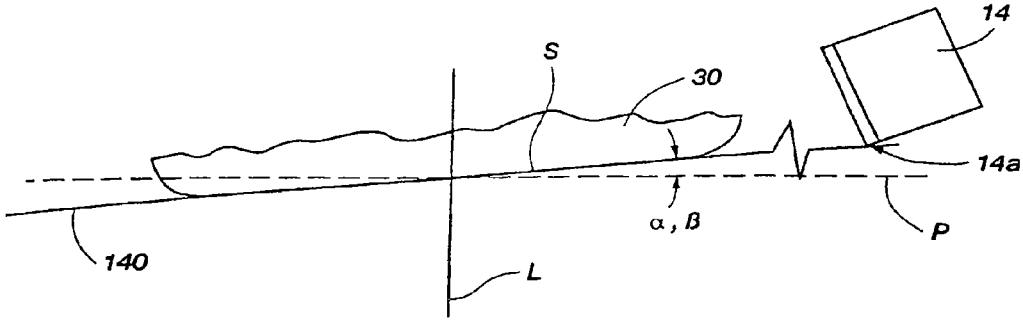
FIGS. 6A and 6B are, respectively, schematics of single-angle bearing surface and multi-angle bearing surface DOCC features.
Figure 6B:
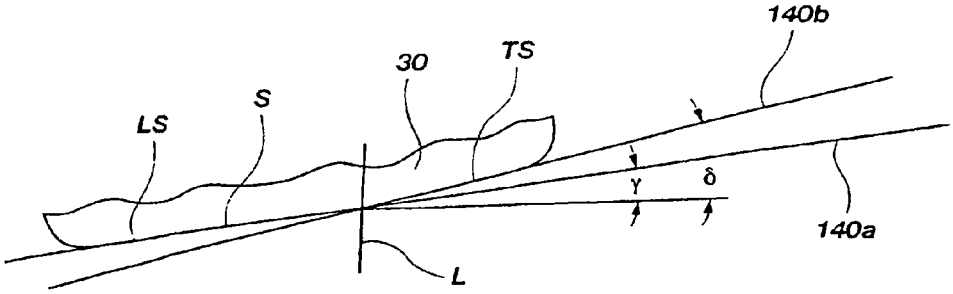

As shown in FIGS. 1 and 2, one or more DOCC features of a bit according to an invention may comprise elongated arcuate bearing segments 30 disposed at substantially the same radius about the bit longitudinal axis or centerline as a cutter preceded by that DOCC feature. In such an instance, and as depicted in FIG. 6A with exemplary arcuate bearing segment 30 unscrolled to lie flat on the page, it is preferred that the outer bearing surface S of a segment 30 be sloped at an angle $\alpha$ to a plane P transverse to the centerline L of the bit substantially the same as the angle $\beta$ (of the helical path 140)

traveled by associated PDC cutter 14 as the bit drills the borehole. By so orienting the outer bearing surface S, the full potential surface, or bearing area of bearing segment 30 contacts and remains in contact with the formation as the PDC cutter 14 rotates. As shown in FIG. 6B, the outer surface S of an arcuate segment 30 may also be sloped at a variable angle to accommodate maximum and minimum design ROP for a bit. Thus, if a bit is designed to drill between 110 and 130 fph, the rotationally leading portion LS of surface S may be at one, relatively shallower angle γ, while the rotationally trailing portion TS of surface S (all of surface S still rotationally leading PDC cutter 14) may be at another, relatively steeper angle δ, (both angles shown in exaggerated magnitude for clarity) the remainder of surface S gradually transitioning in an angle therebetween. In this manner, and since DOC must necessarily increase for ROP to increase, given a substantially constant rotational speed, at a first, shallower helix angle 140*a* corresponding to a lower ROP, the leading portion LS of surface S will be in contact with the formation being drilled, while at a higher ROP the helix angle will steepen, as shown (exaggerated for clarity) by comparatively steeper helix angle 140*b* and leading portion LS will no longer contact the formation, the contact area being transitioned to more steeply angled trailing portion TS. Of course, at an ROP intermediate the upper and lower limits of the design range, a portion of surface S intermediate leading portion LS and trailing portion TS (or portions of both LS and TS) would act as the bearing surface. A configuration as shown in FIG. 6B is readily suitable for high compressive strength formations at varying ROPs within a design range, since bearing surface area requirements for the DOCC features are nominal. For bits used in drilling softer formations, it may be necessary to provide excess surface area for each DOCC feature to prevent formation failure and indentation, as only a portion of each DOCC feature will be in contact with the formation at any one time when drilling over a design range of ROPs. Conversely, for bits used in drilling harder formations, providing excess surface area for each DOCC feature to prevent formation failure and indentation may not be necessary as the respective portions of each DOCC feature may, when taken in combination, provide enough total bearing surface area, or total size, for the bit to ride on the formation over a design range of ROPs.

Another consideration in the design of bits according to the present invention is the abrasivity of the formation being drilled, and relative wear rates of the DOCC features and the PDC cutters. In non-abrasive formations this is not of major concern, as neither the DOCC feature nor the PDC cutter will wear appreciably. However, in more abrasive formations, it may be necessary to provide wear inserts 32 (see FIG. 1) or otherwise protect the DOCC features against excessive (i.e., premature) wear in relation to the cutters with which they are associated to prevent reduction in DOC. For example, if the bit is a matrix-type bit, a layer of diamond grit may be embedded in the outer surfaces of the DOCC features. Alternatively, pre-formed cemented tungsten carbide slugs cast into the bit face may be used as DOCC features. A diamond film may be formed on selected portions of the bit face using known chemical vapor deposition techniques as known in the art, or diamond films formed on substrates which are then cast into or brazed or otherwise bonded to the bit body. Natural diamonds, thermally stable PDCs (commonly termed TSPs) or even PDCs with faces thereon substantially parallel to the helix angle of the cutter path (so that what would normally be the cutting face of the PDC acts as a bearing surface), or cubic boron nitride structures similar to the aforementioned diamond structures may also be employed on, or as, bearing surfaces of the DOCC features, as desired or required, for example when drilling in limestones and dolomites. In order to reduce frictional forces between a DOCC bearing surface and the formation, a very low roughness, so-called "polished" diamond surface may be employed in accordance with U.S. Pat. Nos. 5,447,208 and 5,653,300, assigned to the assignee of the present invention and hereby incorporated herein by this reference. Ideally, and taking into account wear of the diamond table and supporting substrate in comparison to wear of the DOCC features, the wear characteristics and volumes of materials taking the wear for the DOCC features may be adjusted so that the wear rate of the DOCC features may be substantially matched to the wear rate of the PDC cutters to maintain a substantially constant DOC. This approach will result in the ability to use the PDC cutter to its maximum potential life. It is, of course, understood that the DOCC features may be configured as abbreviated "knots," "bosses," or large "mesas," as well as the aforementioned arcuate segments or may be of any other configuration suitable for the formation to be drilled to prevent failure thereof by the DOCC features under expected or planned WOB.

As an alternative to a fixed, or passive, DOCC feature, it is also contemplated that active DOCC features or bearing segments may be employed to various ends. For example, rollers may be disposed in front of the cutters to provide reduced-friction DOCC features, or a fluid bearing comprising an aperture surrounded by a pad or mesa on the bit face may be employed to provide a standoff for the cutters with attendant low friction. Movable DOCC features, for example pivotable structures, might also be used to accommodate variations in ROP within a given range by tilting the bearing surfaces of the DOCC features so that the surfaces are oriented at the same angle as the helical path of the associated cutters.

Referring now to FIGS. 7 through 12 of the drawings, various DOCC features (which may also be referred to as bearing segments) according to the invention are disclosed.

Figure 7:
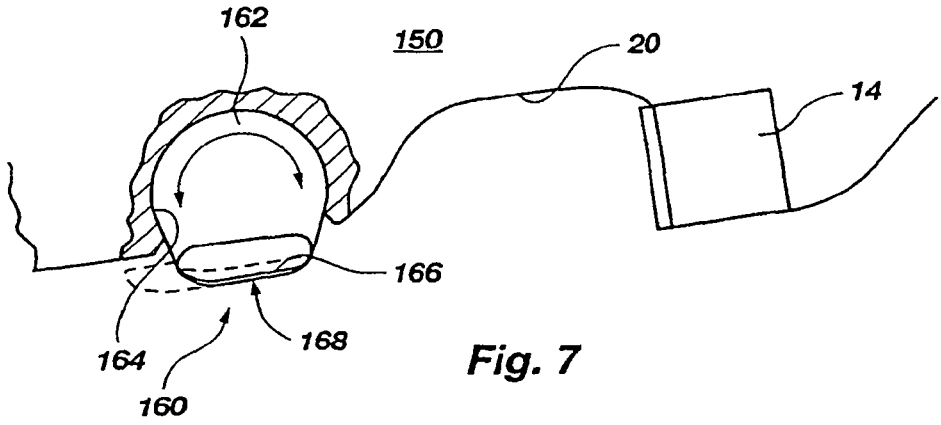
FIGS. 7 and 7A are, respectively, a schematic side partial sectional elevation of an embodiment of a pivotable DOCC feature and associated trailing PDC cutter, and an elevation looking forward at the pivotable DOCC feature from the location of the associated PDC cutter.
Figure 7A:
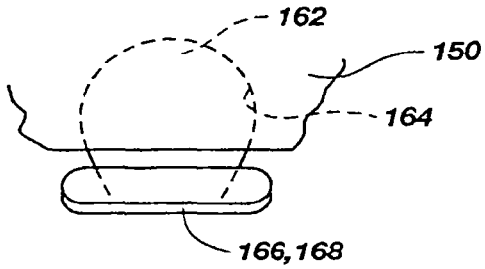

Referring to FIGS. 7 and 7A, exemplary bit 150 having PDC cutter 14 secured thereto rotationally trailing fluid course 20 includes pivotable DOCC feature 160 comprised of an arcuate-surfaced body 162 (which may comprise a hemisphere for rotation about several axes or merely an arcuate surface extending transverse to the plane of the page for rotation about an axis transverse to the page) secured in socket 164 and having an optional wear-resistant feature 166 on the bearing surface 168 thereof. Wear-resistant feature 166 may merely be an exposed portion of the material of body 162 if the latter is formed of, for example, WC. Alternatively, wear-resistant feature 166 may comprise a WC tip, insert or cladding on bearing surface 168 of body 162, diamond grit embedded in body 162 at bearing surface 168, or a synthetic or natural diamond surface treatment of bearing surface 168, including specifically and without limitation, a diamond film deposited thereon or bonded thereto. It should be noted that the area of the bearing surface 168 of the DOCC feature 160 which will ride on the formation being drilled, as well as the DOC for PDC cutter 14, may be easily adjusted for a given bit design by using bodies 162 exhibiting different exposures (heights) of the bearing surface 168 and different widths, lengths or cross-sectional configurations, all as shown in broken lines. Thus, different formation compressive strengths may be accommodated. The use of a pivotable DOCC feature 160 permits the DOCC feature to automatically adjust to different ROPs within a given range of cutter helix angles. While DOC may be affected by pivoting of the DOCC feature 160, variation within a given range of ROPs will usually be nominal.

Figure 8:
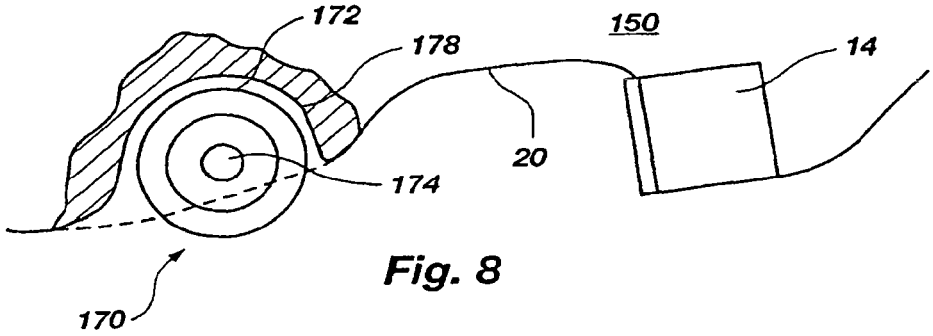
FIGS. 8 and 8A are, respectively, a schematic side partial sectional elevation of an embodiment of a roller-type DOCC feature and associated trailing cutter, and a transverse partial cross-sectional view of the mounting of the roller-type DOCC features to the bit.
Figure 8A:
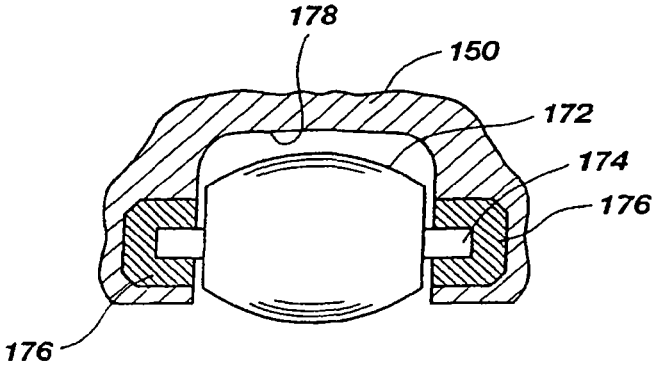
Figure 9A:
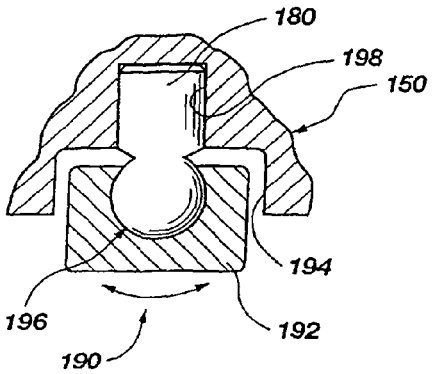
FIGS. 9A-9D depict additional schematic partial sectional elevations of further pivotable DOCC features according to the invention.
Figure 9B:
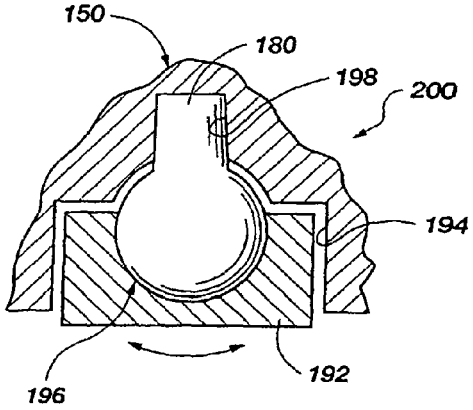
Figure 9C:
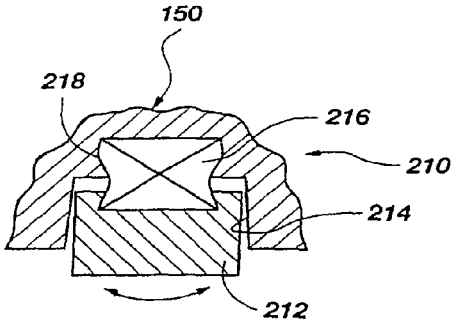
Figure 9D:
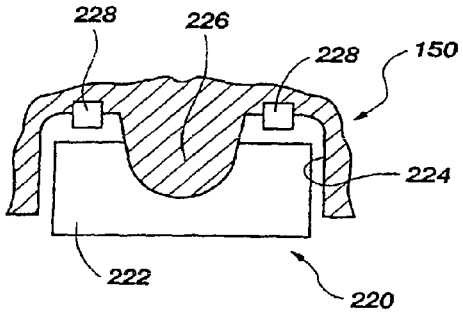

FIGS. 8 and 8A depict exemplary bit 150 having PDC cutter 14 secured thereto rotationally trailing fluid course 20, wherein bit 150 in this instance includes DOCC feature 170 including roller 172 rotationally mounted by shaft 174 to bearings 176 carried by bit 150 on each side of cavity 178 in which roller 172 is partially received. In this embodiment, it should be noted that the exposure and bearing surface area of DOCC feature 170 may be easily adjusted for a given bit design by using different diameter rollers 172 exhibiting different widths and/or cross-sectional configurations.

FIGS. 9A, 9B, 9C and 9D respectively depict alternative pivotable DOCC features 190, 200, 210 and 220. DOCC feature 190 includes a head 192 partially received in a cavity 194 in a bit 150 and mounted through a ball and socket connection 196 to a stud 180 press-fit into aperture 198 at the top of cavity 194. DOCC feature 200, wherein elements similar to those of DOCC feature 190 are identified by the same reference numerals, is a variation of DOCC feature 190. DOCC feature 210 employs a head 212, which is partially received in a cavity 214 in a bit 150 and secured thereto by a resilient or ductile connecting element 216 which extends into aperture 218 at the top of cavity 214. Connecting element 216 may comprise, for example, an elastomeric block, a coil spring, a belleville spring, a leaf spring, or a block of ductile metal, such as steel or bronze. Thus, connecting element 216, as with the ball and socket connections 196 and heads 192, permits head 212 to automatically adjust to, or compensate for, varying ROPs defining different cutter helix angles. DOCC feature 220 employs a yoke 222 rotationally disposed and partially received within cavity 224, yoke 222 supported on protrusion 226 of bit 150. Stops 228, of resilient or ductile materials (such as elastomers, steel, lead, etc.) and which may be permanent or replaceable, permit yoke 222 to accommodate various helix angles. Yoke 222 may be secured within cavity 224 by any conventional means. Since helix angles vary even for a given, specific ROP as distance of each cutter from the bit centerline, affording such automatic adjustment or compensation may be preferable to trying to form DOCC features with bearing surfaces at different angles at different locations over the bit face.

Figure 10A:
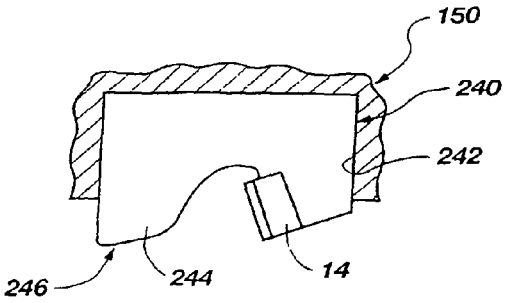
FIGS. 10A and 10B are schematic side partial sectional elevations of variations of a combination cutter carrier and DOCC features according to the present invention.
Figure 10B:
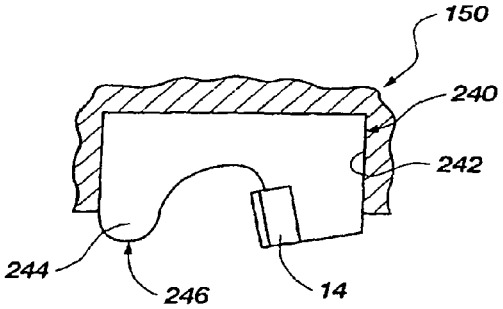

FIGS. 10A and 10B respectively depict different DOCC features and PDC cutter combinations. In each instance, a PDC cutter 14 is secured to a combined cutter carrier and DOC limiter 240, the cutter carrier and DOC limiter 240 being received within a cavity 242 in the face (or on a blade) of an exemplary bit 150 and secured therein as by brazing, welding, mechanical fastening, or otherwise as known in the art. The cutter carrier and DOC limiter 240 includes a protrusion 244 exhibiting a bearing surface 246. As shown and by way of example only, bearing surface 246 may be substantially flat (FIG. 10A) or hemispherical (FIG. 10B). By selecting an appropriate cutter carrier and DOC limiter 240, the DOC of PDC cutter 14 may be varied and the surface area of bearing surface 246 adjusted to accommodate a target formation's compressive strength.

It should be noted that the DOCC features of FIGS. 7 through 10, in addition to accommodating different formation compressive strengths, as well as optimizing DOC and permitting minimization of friction-causing bearing surface area while preventing formation failure under WOB, also facilitate field repair and replacement of DOCC features due to drilling damage or to accommodate different formations to be drilled in adjacent formations, or intervals, to be penetrated by the same borehole.

Figure 11:
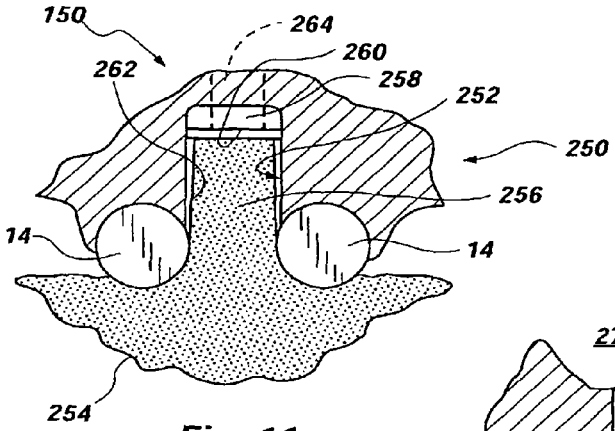
FIG. 11 is a frontal elevation of an annular channel-type DOCC feature in combination with associated trailing PDC cutters.

FIG. 11 depicts a DOCC feature 250 comprised of an annular cavity or channel 252 in the face of an exemplary bit 150. Radially adjacent PDC cutters 14 flanking annular channel 252 cut the formation 254 but do not cut annular segment 256, which protrudes into annular cavity 252. At the top 260 of annular channel 252, a flat-edged PDC cutter 258 (or preferably a plurality of rotationally spaced cutters 258) truncates annular segment 256 in a controlled manner so that the height of annular segment 256 remains substantially constant and limits the DOC of flanking PDC cutters 14. In this instance, the bearing surface of the DOCC feature 250 comprises the top 260 of annular channel 252, and the sides 262 of channel 252 prevent collapse of annular segment 256. Of course, it is understood that multiple annular channels 252 with flanking PDC cutters 14 may be employed and that a source of drilling fluid, such as aperture 264, would be provided to lubricate channel 252 and flush formation cuttings from PDC cutter 258.

Figure 12:
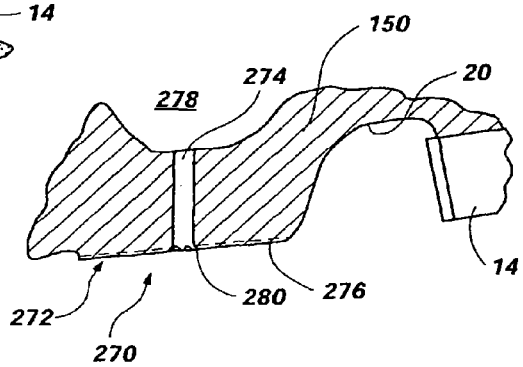
FIGS. 12 and 12A are, respectively, a schematic side partial sectional elevation of a fluid bearing pad-type DOCC feature according to the present invention and an associated trailing PDC cutter and an elevation looking upward at the bearing surface of the pad.
Figure 12A:
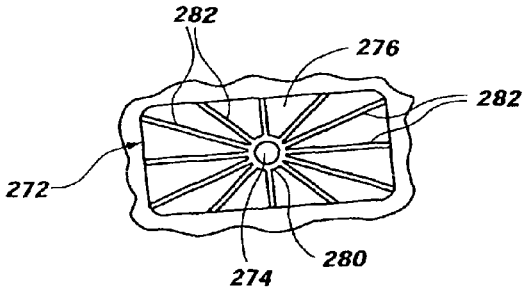

FIGS. 12 and 12A depict a low-friction, hydraulically enhanced DOCC feature 270 comprised of a DOCC pad 272 rotationally leading a PDC cutter 14 across fluid course 20 on exemplary bit 150, pad 272 being provided with drilling fluid through passage 274 leading to the bearing surface 276 of pad 272 from a plenum 278 inside the body of bit 150. As shown in FIG. 12A, a plurality of channels 282 may be formed on bearing surface 276 to facilitate distribution of drilling fluid from the mouth 280 of passage 274 across bearing surface 276. By diverting a small portion of drilling fluid flow to the bit 150 from its normal path leading to nozzles associated with the cutters, it is believed that the increased friction normally attendant with WOB increases after the bearing surface 276 of DOCC pad 272 contacts the formation may be at least somewhat alleviated or, in some instances, substantially avoided, which may reduce or eliminate torque increases responsive to increases of WOB. Of course, passages 274 may be sized to provide appropriate flow, or pads 272 sized with appropriately dimensioned mouths 280. Pads 272 may, of course, be configured for replaceability.

As has been mentioned above, backrakes of the PDC cutters employed in a bit equipped with DOCC features according to the invention may be more aggressive, that is to say, less negative, than with conventional bits. It is also contemplated that extremely aggressive cutter rakes, including neutral rakes and even positive (forward) rakes of the cutters, may be successfully employed consistent with the cutters' inherent strength to withstand the loading thereon as a consequence of such rakes, since the DOCC features will prevent such aggressive cutters from engaging the formation to too great a depth.

It is also contemplated that two different heights, or exposures, of bearing segments may be employed on a bit, a set of higher bearing segments providing a first bearing surface area supporting the bit on harder, higher compressive strength formations providing a relatively shallow DOC for the PDC cutters of the bit, while a set of lower bearing segments remains out of contact with the formation while drilling until a softer, lower compressive stress formation is encountered. At that juncture, the higher or more exposed bearing segments will be of insufficient surface area to prevent indentation (failure) of the formation rock under applied WOB. Thus, the higher bearing segments will indent the formation until the second set of bearing segments comes in contact therewith, whereupon the combined surface area of the two sets of bearing segments will support the bit on the softer formation, but at a greater DOC to permit the cutters to remove a greater volume of formation material per rotation of the bit and thus generate a higher ROP for a given bit rotational speed. This approach differs from the approach illustrated in FIG. 5, in that, unlike stepped DOCC features (feature 130), bearing segments of differing heights or exposures are associated with different cutters. Thus, this aspect of the invention may be effected, for example, in the bits 10 and 100 of FIGS. 1 and 2 by fabricating selected arcuate bearing segments to a greater height or exposure than others. Thus, bearing segments 30*b* and 30*e* of bits 10 and 100 may exhibit a greater exposure than segments 30*a*, 30*c*, 30*d* and 30*f*, or vice versa.

Cutters employed with bits 10 and 100, as well as other bits disclosed that will be discussed subsequently herein, are depicted as having PDC cutters 14, but it will be recognized and appreciated by those of ordinary skill in the art that the invention may also be practiced on bits carrying other types of superabrasive cutters, such as thermally stable polycrystalline diamond compacts, or TSPs, for example, arranged into a mosaic pattern as known in the art to simulate the cutting face of a PDC. Diamond film cutters may also be employed, as well as cubic boron nitride compacts.

Another embodiment of the present invention, as exemplified by rotary drill bits 300 and 300', is depicted in FIGS. 14A-20. Rotary drill bits, such as drill bits 300 and 300N, according to the present invention, may include many features and elements which correspond to those identified with respect to previously described and illustrated bits 10 and 100.

Figure 14A:
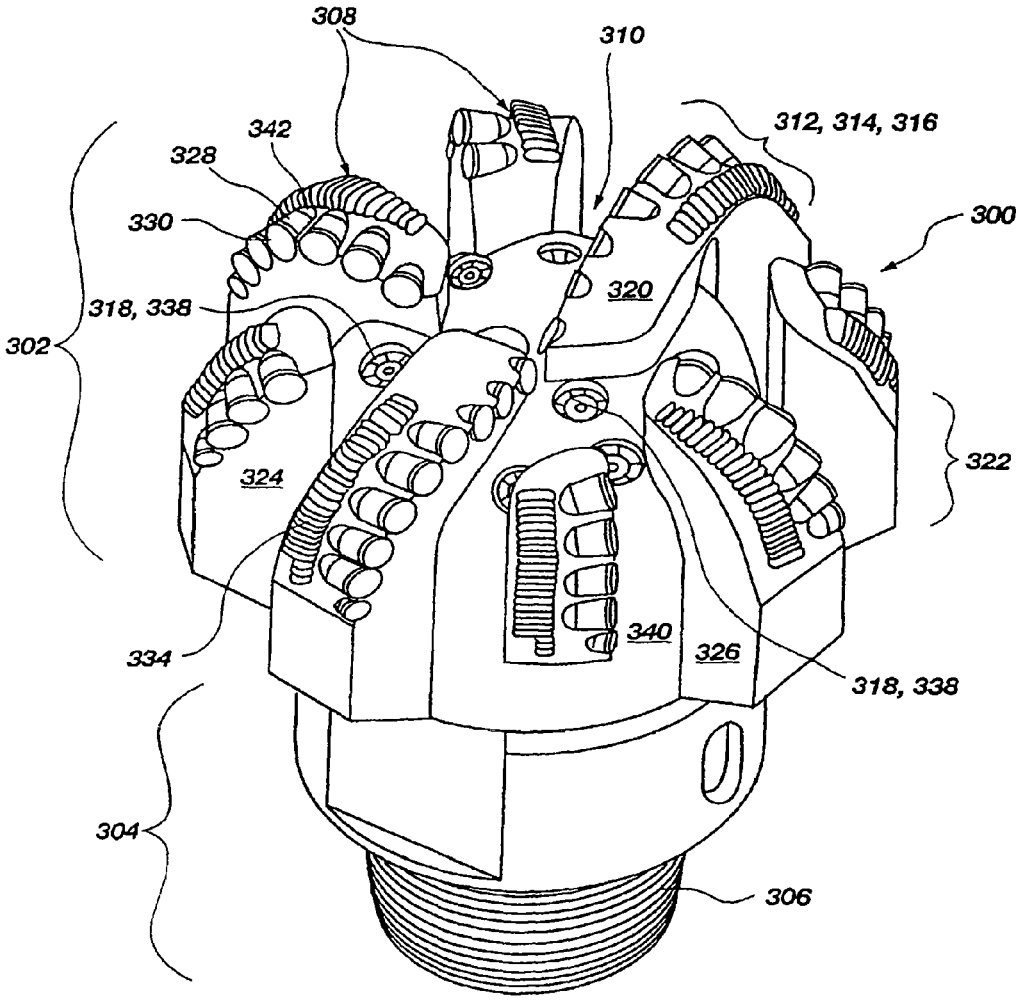
FIG. 14A is a perspective view of the face of one embodiment of a drill bit having eight blade structures including reduced exposure cutters disposed on at least some of the blades in accordance with the present invention.
Figure 14B:
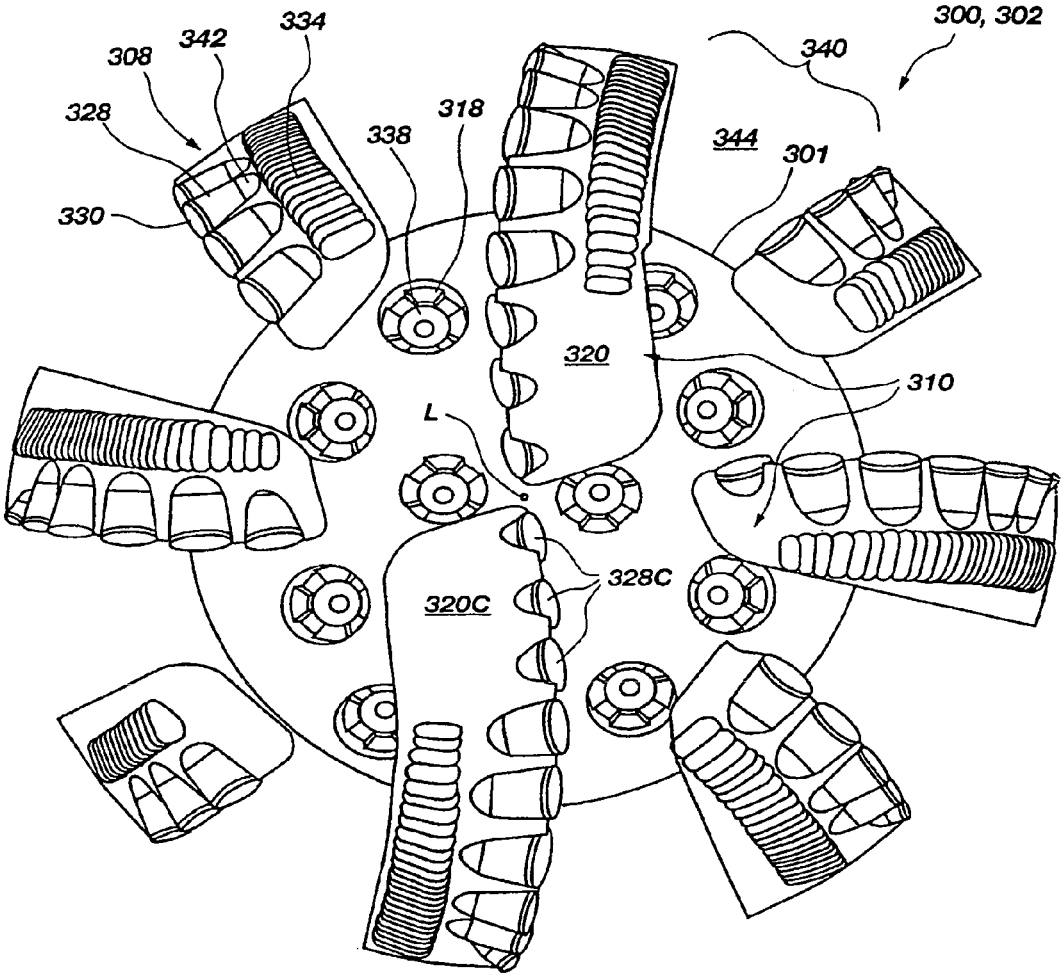
FIG. 14B is a bottom view of the face of the exemplary drill bit of FIG. 14A.
Figure 14C:
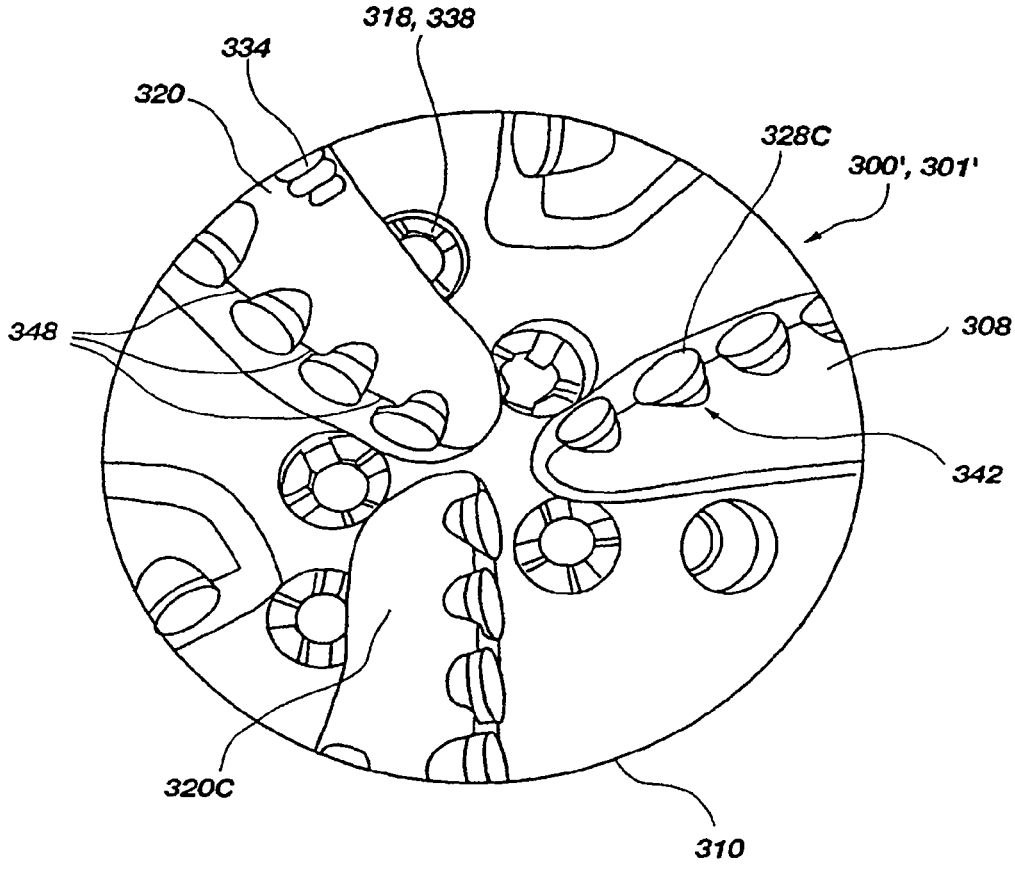
FIG. 14C is a bottom view of the face of another exemplary drill bit embodying the present invention having six blade structures and a different cutter profile than the cutter profile of the exemplary bit illustrated in FIGS. 14A and 14B.

Representative rotary drill bit 300 shown in FIGS. 14A and 14B, includes a bit body 301 having a leading end 302 and a trailing end 304. Connection 306 may comprise a pin-end connection having tapered threads for connecting bit 300 to a bottom hole assembly of a conventional rotating drill string, or alternatively, for connection to a downhole motor assembly, such as a drilling fluid powered Moineau-type downhole motor, as described earlier. Leading end 302, or drill bit face, includes a plurality of blade structures 308 generally extending radially outwardly and longitudinally toward trailing end 304. Exemplary bit 300 comprises eight blade structures 308, or blades, spaced circumferentially about the bit. However, a fewer number of blades may be provided on a bit such as provided on bit body 301' of bit 300' shown in FIG. 14C which has six blades. A greater number of blade structures of a variety of geometries may be utilized as determined to be optimum for a particular drill bit. Furthermore, blade structures 308 need not be equidistantly spaced about the circumference of drill bit 300 as shown, but may be spaced about the circumference, or periphery, of a bit in any suitable fashion, including a non-equidistant arrangement or an arrangement wherein some of the blades 308 are spaced circumferentially equidistantly from each other and some are irregularly, non-equidistantly spaced from each other. Moreover, blade structures 308 need not be specifically configured in the manner as shown in FIGS. 14A and 14B, but may be configured to include other profiles, sizes, and combinations than those shown.

Generally, a bit, such as bit 300, includes a cone region 310, a nose region 312, a flank region 314, a shoulder region 316, and a gage region 322. Frequently, a specific distinction between flank region 314 and shoulder region 316 may not be made. Thus, the term "shoulder," as used in the art, will often incorporate the "flank" region within the "shoulder" region. Fluid ports 318 are disposed about the face of the bit 300 and are in fluid communication with at least one interior passage provided in the interior of bit body 301 in a manner such as illustrated in FIG. 2A of the drawings and for the purposes described previously herein. Preferably, but not necessarily, fluid ports 318 include nozzles 338 disposed therein to better control the expulsion of drilling fluid from bit body 301 into fluid courses 344 and junk slots 340 in order to facilitate the cooling of cutters on bit 300 and the flushing of formation cuttings up the borehole toward the surface when bit 300 is in operation.

Blade structures 308 preferably comprise, in addition to gage region 322, a radially outward facing bearing surface 320, a rotationally leading surface 324, and a rotationally trailing surface 326. That is, as the bit 300 is rotated in a subterranean formation to create a borehole, leading surface 324 will be facing the intended direction of bit rotation while trailing surface 326 will be facing opposite, or backwards from, the intended direction of bit rotation. A plurality of cutting elements, or cutters 328, is preferably disposed along and partially within blade structures 308. Specifically, cutters 328 are positioned so as to have a superabrasive cutting face, or table 330, generally facing in the same direction as leading surface 324, as well as to be exposed to a certain extent beyond bearing surface 320 of the respective blade in which each cutter is positioned. Cutters 328 are preferably superabrasive cutting elements known within the art, such as the exemplary PDC cutters described previously herein, and are physically secured in pockets 342 by installation and securement techniques known in the art. The preferred amount of exposure of cutters 328 in accordance with the present invention will be described in further detail hereinbelow.

Optional wear knots, wear clouds, or built-up wear-resistant areas, collectively referred to as wear knots 334 herein, may be disposed upon, or otherwise provided on bearing surfaces 320 of blade structures 308 with wear knots 334 preferably being positioned so as to rotationally follow cutters 328 positioned on respective blades or other surfaces in which cutters 328 are disposed. Wear knots 334 may be originally molded into bit 300 or may be added to selected portions of bearing surface 320. As described earlier herein, bearing surfaces 320 of blade structures 308 may be provided with other wear-resistant features or characteristics, such as embedded diamonds, TSPs, PDCs, hard facing, weldings, and weldments for example. As will become apparent, such wear-resistant features can be employed to further enhance and augment the DOCC aspect as well as other beneficial aspects of the present invention.

Figure 15B:
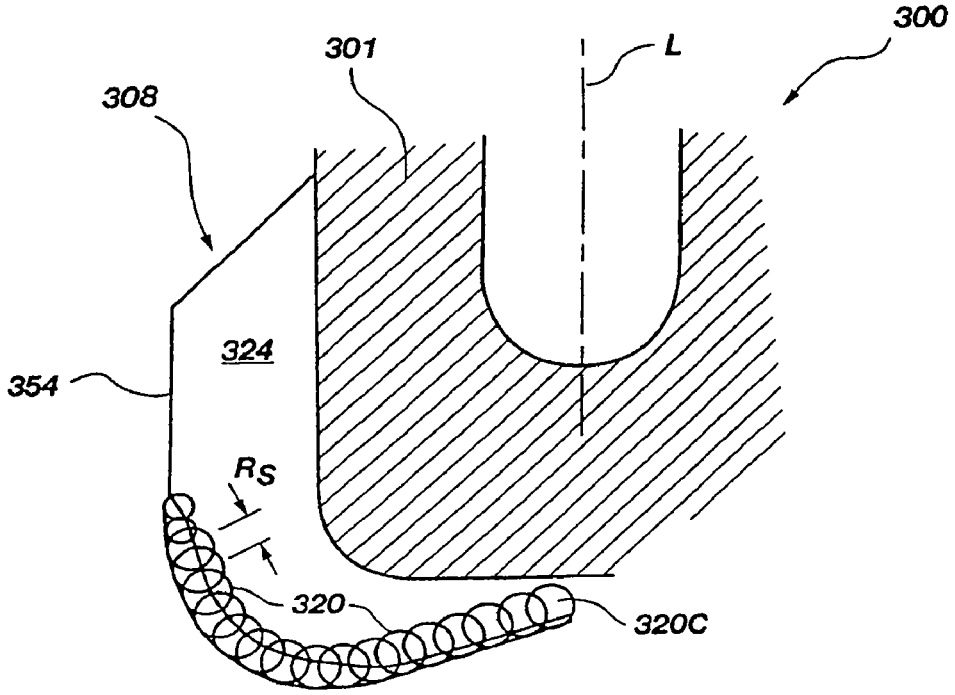
FIG. 15B is a schematic side partial sectional view showing the combined cutter profile, including cutter-to-cutter overlap of the cutters positioned along all the blades, as superimposed upon a single, representative blade.
Figure 15A:
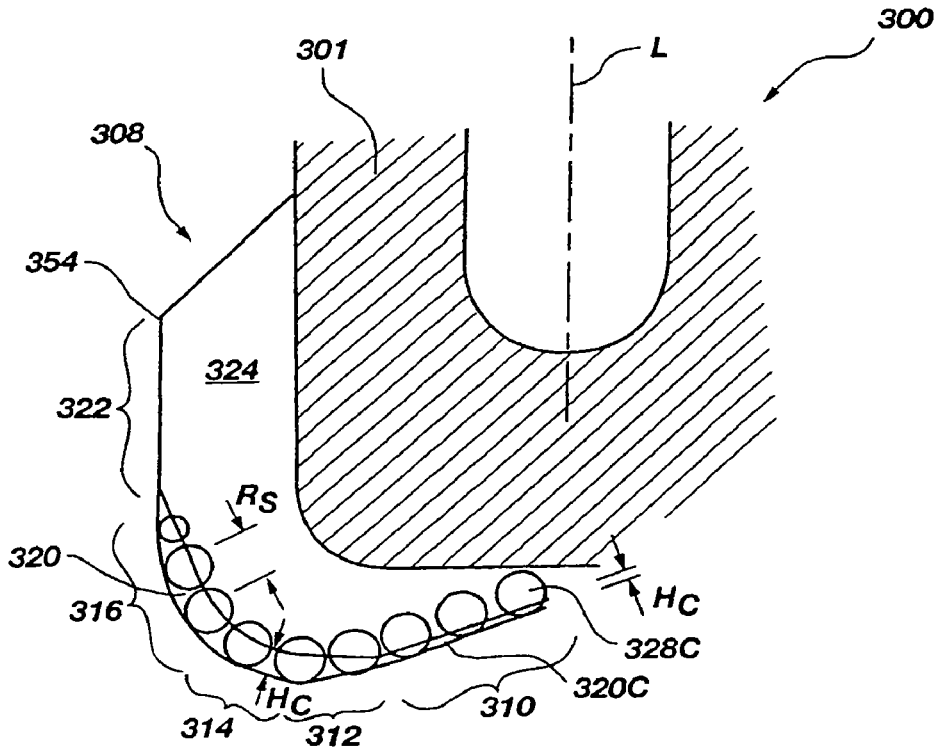
FIG. 15A is a schematic side partial sectional view showing the cutter profile and radial spacing of adjacently positioned cutters along a single, representative blade of a drill bit embodying the present invention.
Figure 15C:
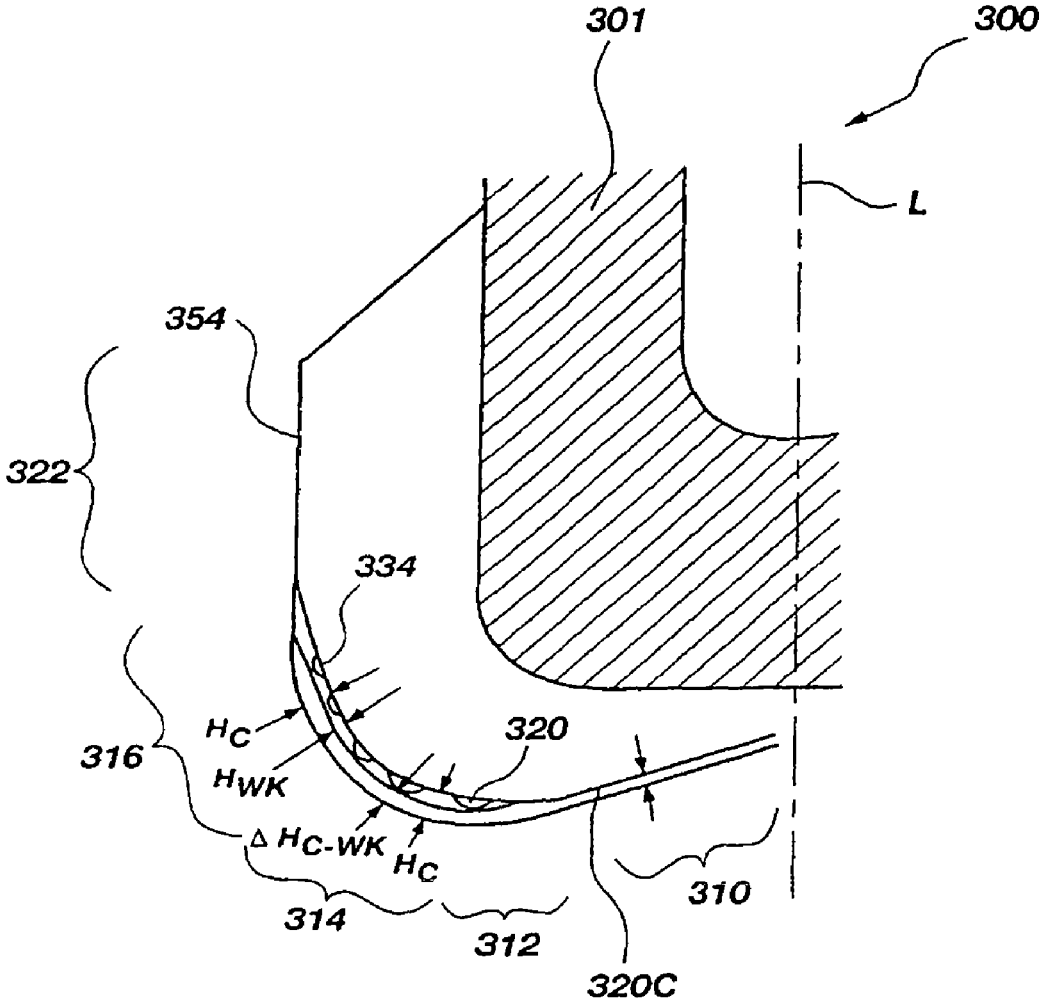
FIG. 15C is a schematic side partial sectional view showing the extent of cutter exposure along the cutter profile as illustrated in FIGS. 15A and 15B with the cutters removed for clarity and further shows a representative, optional wear knot, or wear cloud, profile.

FIGS. 15A-15C highlight the extent in which cutters 328 are exposed with respect to the surface immediately surrounding cutters 328 and particularly cutters 328C located within the radially innermost region of the leading end of a bit proximate the longitudinal centerline of the bit. FIG. 15A provides a schematic representation of a representative group of cutters provided on a bit as the bit rotatingly engages a formation with the cutter profile taken in cross-section and projected onto a single, representative vertical plane (i.e., the drawing sheet). Cutters 328 are generally radially, or laterally, positioned along the face of the leading end of a bit, such as representative bit 300, so as to provide a selected center-to-center radial, or lateral spacing between cutters referred to as center-to-center cutter spacing $R_s$. Thus, if a bit is provided with a blade structure, such as blade structures 308, the cutter profile of FIG. 15A represents the cutters positioned on a single representative blade structure 308. As exaggeratedly illustrated in FIG. 15A, cutters 328C located in cone region 310 are preferably disposed into blade structures 308 so as to have a cutter exposure $H_c$ generally perpendicular to the outwardly facing bearing surface 320 of blade structures 308 by a selected amount. As can be seen in FIG. 15A, cutter exposure $H_c$ is of a preferably relative small amount of standoff, or exposure, distance in cone region 310 of bit 300. Preferably, cutter exposure $H_c$ generally differs for each of the cutters or groups of cutters positioned more radially distant from centerline L. For example cutter exposure $H_c$ is generally greater for cutters 328 in nose region 312 than it is for cutters 328 located in cone region 310 and cutter exposure $H_c$ is preferably at a maximum in flank/shoulder regions 314/316. Cutter exposure $H_c$ preferably diminishes slightly radially toward gage region 322, and radially outermost cutters 328 positioned longitudinally proximate gage pad surface 354 of gage region 322 may incorporate cutting faces of smaller cross-sectional diameters as illustrated. Gage line 352 (see FIGS. 16 and 17) defines the maximum outside diameter of bit 300.

The cross-sectional profile of optional wear knots 334, wear clouds, hard facing, or surface welds have been omitted for clarity in FIG. 15A. However, FIG. 15C depicts the rotational cross-sectional profile, as superimposed upon a single, representative vertical plane of representative optional wear knots 334, wear clouds, hard facing, surface welds, or other wear knot structures. FIG. 15C further illustrates an exemplary cross-sectional wear knot height $H_{wk}$ measured generally perpendicular to outwardly facing bearing surface 320. There may or may not be a generally radial dimensional difference, or relief, $\Delta H_{c\text{-}wk}$, between wear knot height $H_{wk}$, which generally corresponds to a radially outermost surface of a given wear knot or structure, and respective cutter exposure $H_c$, which generally corresponds to the radially outermost portion of the rotationally associated cutter, to further provide a DOCC feature in accordance with the present invention. Conceptually, these differences in exposures can be regarded as analogous to the distance of PDC cutter 14 and rotationally trailing DOC limiter 50 as measured from the dashed reference line illustrated in FIG. 4 and as described earlier. Furthermore, instead of referring to the distance in which the radially outermost surface of a given wear knot structure is positioned radially outward from a bearing surface or blade structure in which a particular wear knot structure is disposed upon, it may be helpful to alternatively refer to a preselected distance in which the radially outermost surface of a given wear knot structure is radially/longitudinally inset, or relieved, from the outermost portion of the exposed portion of a rotationally associated superabrasive cutter as denoted as $\Delta H_{c\text{-}wk}$ in FIG. 15C. Thus, in addition to controlling the DOC with at least certain cutters, and perhaps every cutter, by selecting an appropriate cutter exposure height $H_c$ as defined and illustrated herein, the present invention further encompasses optionally providing drill bits with wear knots, or other similar cutter depth limiting structures, to complement, or augment, the control of the DOCs of respectively rotationally associated cutters, wherein such optionally provided wear knots are disposed on the bit so as to have a wear knot surface that is positioned, or relieved, a preselected distance $\Delta H_{c\text{-}wk}$ as measured from the outermost exposed portion of the cutter in which a wear knot is rotationally associated to the wear knot surface.

The superimposed cross-sectional cutter profile of a representative drill bit such as bit 300 in FIG. 15B depicts the combined profile of all cutters installed on each of a plurality of blade structures 308 so as to have a selected center-to-center radial cutter spacing $R_s$. Thus, the cutter profile illustrated in FIG. 15B is the result of all of the cutters provided on a plurality of blades and rotated about the centerline of the bit to be superimposed upon a single, representative blade structures 308. In some embodiments, there will likely be several cutter redundancies at identical radial locations between various cutters positioned on respective, circumferentially spaced blades, and, for clarity, such profiles which are perfectly, or absolutely, redundant are typically not illustrated. As can be seen in FIG. 15B, there will be a lateral, or radial, overlap between respective cutter paths as the variously provided cutters rotationally progress generally tangential to longitudinal axis L as the bit 300 rotates so as to result in a uniform cutting action being achieved as the drill bit rotatingly engages a formation under a selected WOB. Additionally, it can be seen in FIG. 15B that the lateral, or radial, spacing between individual cutter profiles need not be of the same, uniform distance with respect to the radial, or lateral, position of each cutter. This non-uniform spacing with respect to the radial, or lateral, positioning of each cutter is more clearly illustrated in FIGS. 16 and 17.

Figure 16:
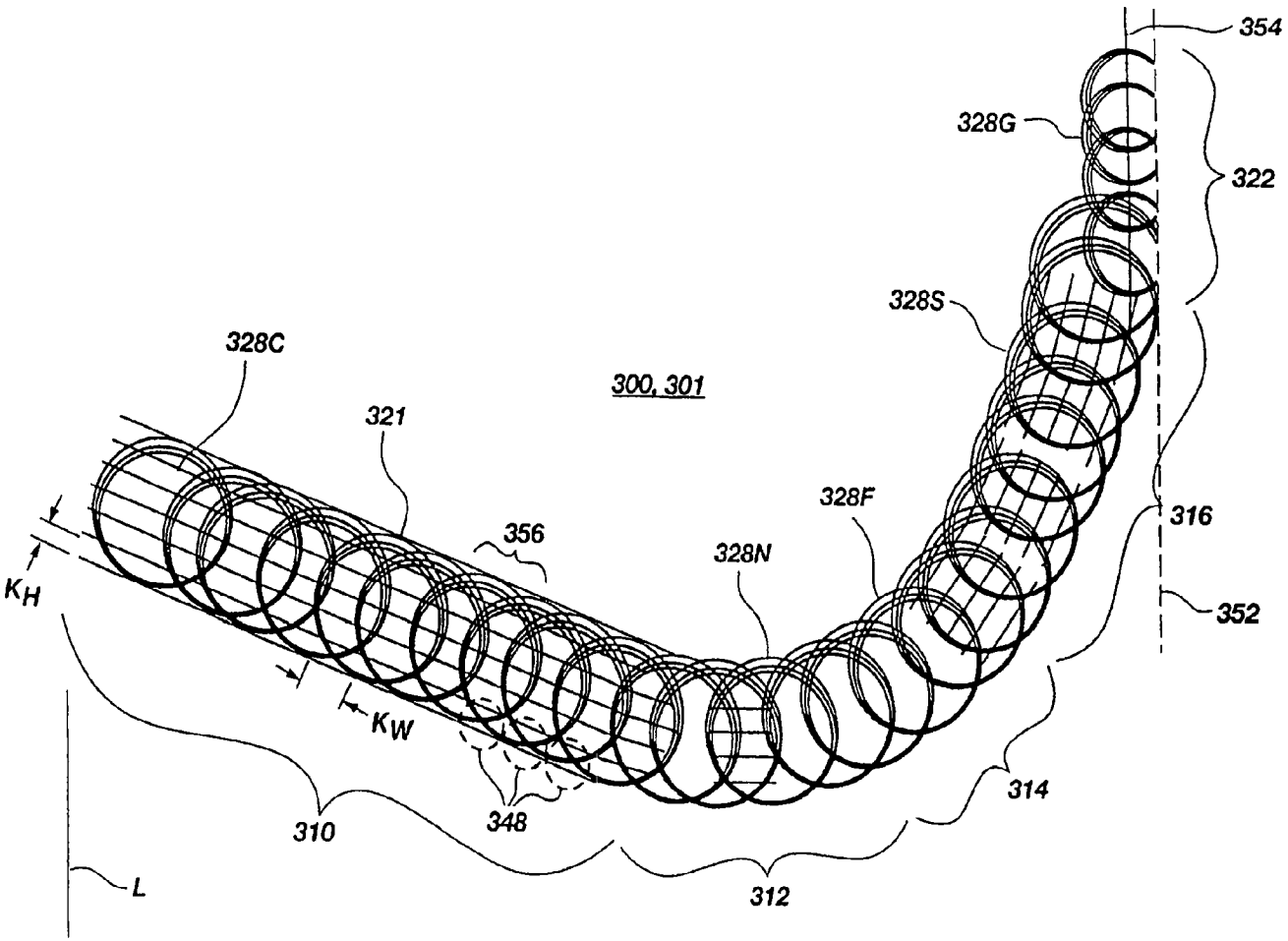
FIG. 16 is an enlarged, isolated schematic side partial sectional view illustrating an exemplary superimposed cutter profile having a relative low amount of cutter overlap in accordance with the present invention.
Figure 17:
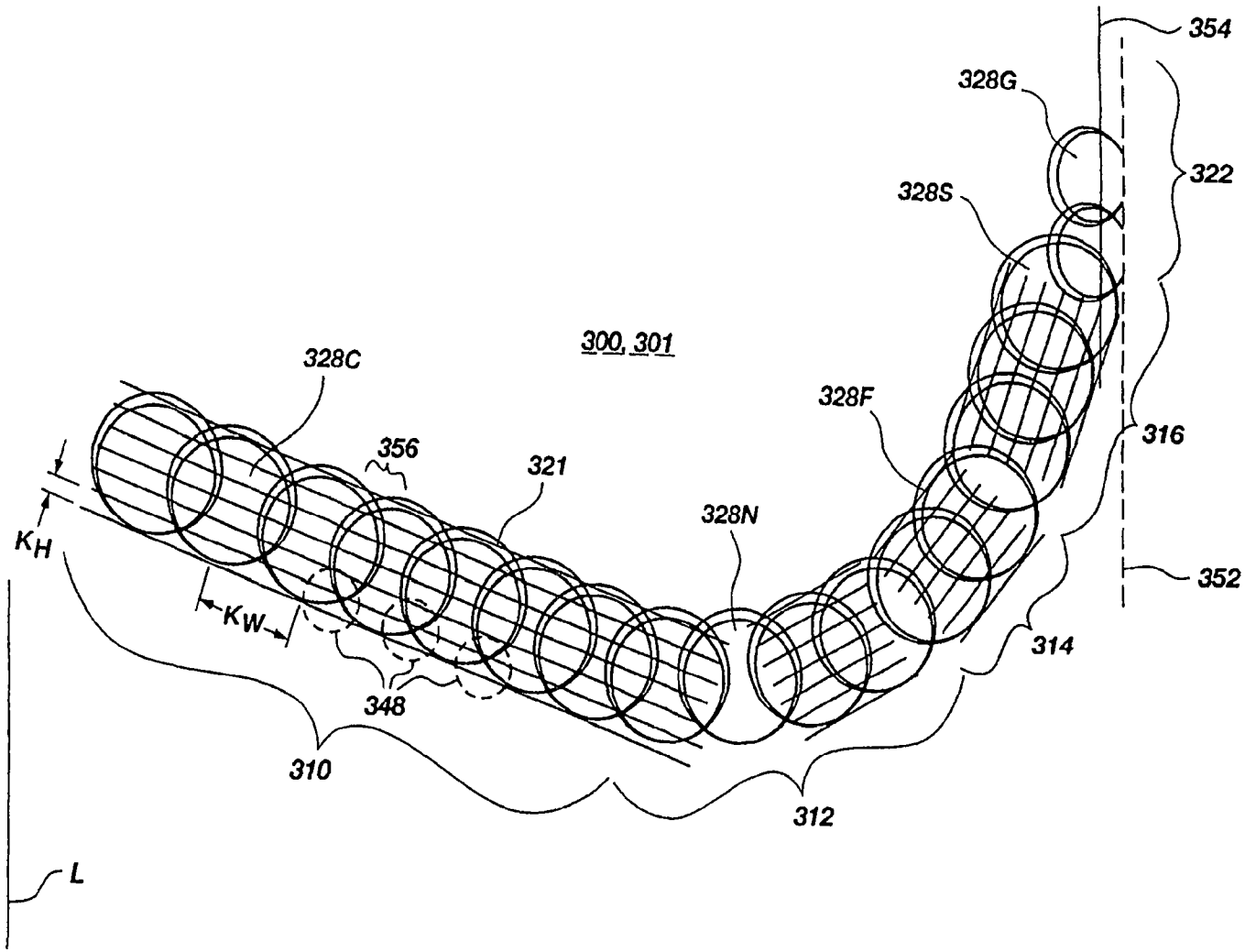
FIG. 17 is an enlarged, isolated schematic side partial sectional view illustrating an exemplary superimposed cutter profile having a relative high amount of cutter overlap in accordance with the present invention.

FIGS. 16 and 17 are enlarged, isolated partial cross-sectional cutter profile views to which all of the cutters located on a bit are superimposed as if on a single cross-sectional portion of a bit body 301 or cutters 328 of a bit, such as bit 300. The cutter profiles of FIGS. 16 and 17 are illustrated as being to the right of longitudinal centerline L of a representative bit, such as bit 300, instead of the left, as illustrated in FIGS. 15A-15C. As described, the leading end of bit 300 includes cone region 310, which includes cutters 328C; nose region 312, which includes cutters 328N; flank region 314, which includes cutters 328F; shoulder region 316, which includes cutters 328S; and gage region 322, which includes cutters 328G; wherein the cutters in each region may be referred to collectively as cutters 328. FIG. 16 illustrates a cutter profile exhibiting a high degree, or amount, of cutter overlap 356. That is, cutters 328 as illustrated in FIG. 17 are provided in sufficient quantity and are positioned sufficiently close to each other laterally, or radially, so as to provide a high degree of cutter redundancy as the bit rotates and engages the formation. In contrast, the representative cutter profile illustrated in FIG. 17 exhibits a relatively lower degree, or amount, of cutter overlap 356. That is, the total number of cutters 328 is less in quantity and are spaced further apart with respect to the radial, or lateral, distance between individual, rotationally adjacent cutter profiles. Kerf regions 348, shown in phantom, in FIGS. 16 and 17 reveal a relatively small height for kerf regions 348 of FIG. 16 wherein kerf regions of FIG. 17 are significantly higher. To aid in the illustration of the respective differences in individual kerf region height $K_H$, which, as a practical matter, is directly related to cutter exposure height $H_C$, as well as individual kerf region widths $K_w$, which are directly influenced by the extent of radial overlap of cutters respectively positioned on different blades, a scaled reference grid of a plurality of parallel spaced lines is provided in FIGS. 16 and 17 to highlight the cutter exposure height and kerf region widths. The spacing between the grid lines in FIGS. 16 and 17 are scaled to represent approximately 0.125 of an inch. However, such a 0.125, or ⅛ inch, scale grid is merely exemplary, as dimensionally greater as well as dimensionally smaller cutter exposure heights, kerf region heights $K_H$, and kerf region widths $K_w$ may be used in accordance with the present invention. The superimposed cutter profile of cutters 328 is illustrated with each of the represented cutters 328 being generally equidistantly spaced along the face of the bit 300 from centerline L toward gage region 322, however, such need not be the case. For example, cutters 328C may have a cutter profile exhibiting more cutter overlap 356 resulting in small kerf widths $K_w$ in cone region 310 as compared to a cutter profile of cutters 328N, 328F, and 328S respectively located in nose region 312, flank region 314, and shoulder region 316, wherein such more radially outward positioned cutters 328 would have less overlap resulting in larger kerf widths $K_w$ therein, or vice versa. Thus, by selectively incorporating the amount of cutter overlap 356 to be provided in each region of a bit, the depth of cut of the cutters in combination with selecting the degree or amount of cutter exposure height of each cutter located in each particular region may be utilized to specifically and precisely control the depth of cut in each region, as well as to design into the bit the amount of available bearing surface surrounding the cutters to which the bit may ride upon the formation. Stated differently, the wider the kerf width $K_w$ between the collective, superimposed, individual cutter profiles of all the cutters on all of the blades, or alternatively, all the cutters radially and circumferentially spaced about a bit, such as cutters 328 provided on a bit as shown in FIG. 17, a greater proportion of the total applied WOB will be dispersed upon the formation allowing the bit to "ride" on the formation than would be the case if a greater quantity of cutters were provided having a smaller kerf width $K_w$ therebetween, as shown in FIG. 16.

Therefore, the cutter profile illustrated in FIG. 17 would result in a considerable portion of the WOB being applied to bit 300 to be dispersed over the wide kerfs and thereby allowing bit 300 to be supported by the formation as cutters 328 engage the formation. This feature of selecting both the total number of kerfs and the widths of the individual kerf widths $K_w$ allows for a precise control of the individual depth-of-cuts of the cutters adjacent the kerfs, as well as the total collective depth-of-cut of bit 300 into a formation of a given hardness. Upon a great enough, or amount of, WOB being applied on the bit when drilling in a given relatively hard formation, the kerf regions 348 would come to ride upon the formation, thereby limiting, or arresting, the DOC of cutters 328. If yet further WOB were to be applied, the DOC would not increase as the kerf regions 348, as well as portions of the outwardly facing surface of the blade surrounding each cutter 328 provided with a reduced amount of exposure in accordance with the present invention, would, in combination, provide a total amount of bearing surface to support the bit in the relative hard formation, notwithstanding an excessive amount of WOB being applied to the bit in light of the current ROP.

Contrastingly, in a bit provided with a cutter profile exhibiting dimensionally small cutter-to-cutter spacings by incorporating a relatively high quantity of cutters 328 with a small kerf region $K_w$ between mutually radially, or laterally, overlapped cutters, such as illustrated in FIG. 16, each individual cutter would engage the formation with a lesser amount of DOC per cutter at a given WOB. Because each cutter would engage the formation at a lesser DOC as compared with the cutter profile of FIG. 17, with all other variables being held constant, the cutters of the cutter profile of FIG. 16 would tend to be better suited for engaging a relatively hard formation where a large DOC is not needed, and is, in fact, not preferred for engaging and cutting a hard formation efficiently. Upon a requisite, or excessive amount of WOB further being applied on a bit having the cutter profile of FIG. 16 in light of the current ROP being afforded by the bit, kerf regions 348 would come to ride upon the formation, as well as other portions of the outwardly facing blade surface surrounding each cutter 328 exhibiting a reduced amount of exposure in accordance with the present invention to limit the DOC of each cutter by providing a total amount of bearing surface to disperse the WOB onto the formation being drilled. In general, larger kerfs will promote dynamic stability over formation cutting efficiency, while smaller kerfs will promote formation cutting efficiency over dynamic stability.

Furthermore, the amount of cutter exposure that each cutter is designed to have will influence how quickly, or easily, the bearing surfaces will come into contact and ride upon the formation to axially disperse the WOB being applied to the bit. That is, a relatively small amount of cutter exposure will allow the surrounding bearing surface to come into contact with the formation at a lower WOB while a relatively greater amount of cutter exposure will delay the contact of the surrounding bearing surface with the formation until a higher WOB is applied to the bit. Thus, individual cutter exposures, as well as the mean kerf widths and kerf heights may be manipulated to control the DOC of not only each cutter, but the collective DOC per revolution of the entire bit as it rotatingly engages a formation of a given hardness and confining pressure at given WOB.

Therefore, FIG. 16 illustrates an exemplary cutter profile particularly suitable for, but not limited to, a "hard formation," while FIG. 17 illustrates an exemplary cutter profile particularly suitable for, but not limited to, a "soft formation." Although the quantity of cutters provided on a bit will significantly influence the amount of kerf provided between radially adjacent cutters, it should be kept in mind that both the size, or diameter, of the cutting surfaces of the cutters may also be selected to alter the cutter profile to be more suitable for either a harder or softer formation. For example, cutters having larger diameter superabrasive tables may be utilized to provide a cutter profile, including dimensionally larger kerf heights and dimensionally larger kerf widths to enhance soft formation cutting characteristics. Conversely, a bit may be provided with cutters having smaller diameter superabrasive tables to provide a cutter profile exhibiting dimensionally smaller kerf heights and dimensionally smaller kerf widths to enhance hard formation cutting characteristics of a bit in accordance with the teachings herein.

Additionally, the full-gage diameter that a bit is to have will also influence the overall cutter profile of the bit with respect to kerf heights and kerf widths, as there will be a greater total amount of bearing surface potentially available to support larger diameter bits on a formation, unless the bit is provided with a proportionately greater number of reduced exposure cutters and, if desired, conventional cutters, so as to effectively reduce the total amount of potential bearing surface area of the bit.

Figure 18A:
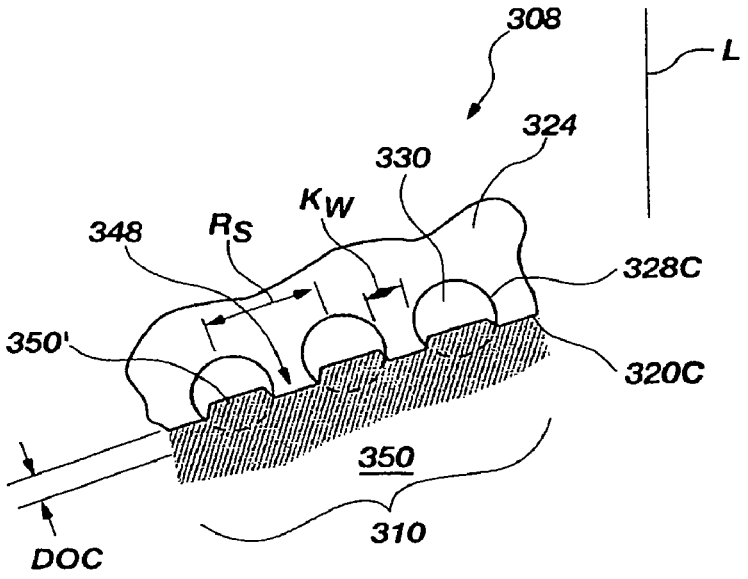
FIG. 18A is an isolated, schematic, frontal view of three representative cutters positioned in the cone region of a representative blade structure of a representative bit, each cutter is exposed at a preselected amount so as to limit the DOC of the cutters, while also providing individual kerf regions between cutters in the bearing surface of the blade in which the cutters are secured contributing to the bit's ability to ride, or rub, upon the formation when a bit embodying the present invention is in operation.

FIG. 18A of the drawings is an isolated, schematic, frontal view of three representative cutters 328C positioned in cone region 310 of a representative blade structure 308. Each of the representative cutters 328C exhibits a preselected amount of cutter exposure so as to limit the DOC of the cutters 328C while also providing individual kerf regions 348 between cutters 328C (in this particular illustration, kerf width $K_w$ represents the kerf width between cutters which are located on the same blade and exhibit a selected radial spacing $R_s$) and to which the bearing surface of the blade to which the cutters 328C are secured (surface 320C) provides a bearing surface, including kerf regions 348 for the bit to ride, or rub, upon the formation, not currently being cut by this particular blade structure 308, upon the design WOB being exceeded for a given ROP in a formation 350 of certain hardness, or compressive strength. As can be seen in FIG. 18A, this particular view shows a rotationally leading surface 324 advancing toward the viewer and shows superabrasive cutting face or tables 330 of cutters 328C engaging and creating a formation cutting 350', or chip, as the cutters 328C engage the formation at a given DOC.

Figure 18B:
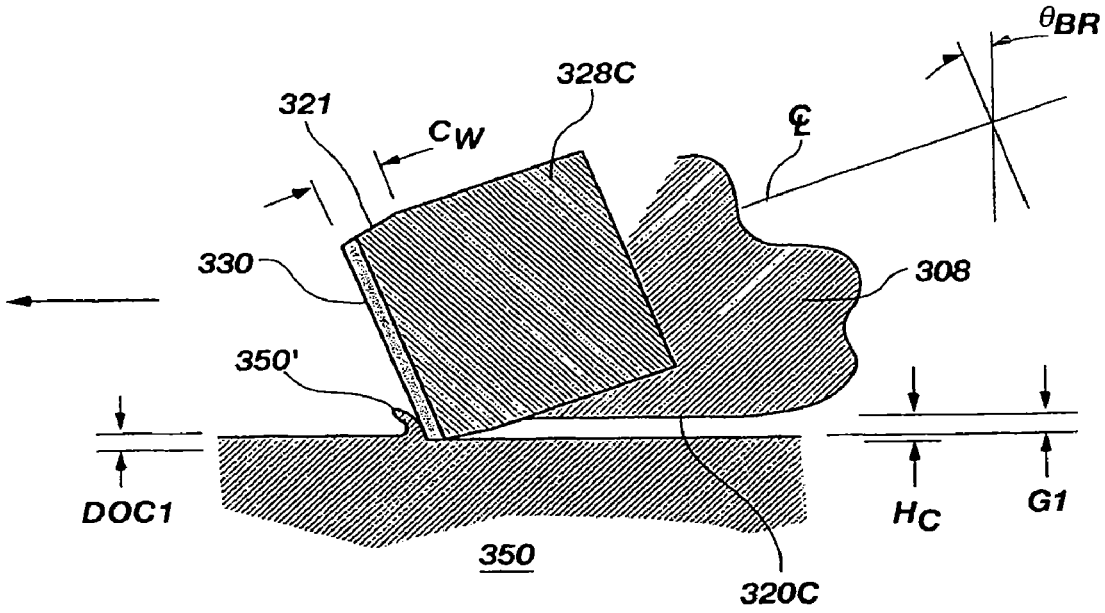
FIG. 18B is a schematic, partial side cross-sectional view of one of the cutters depicted in FIG. 18A as the cutter engages a relatively hard formation and/or engages a formation at a relatively low WOB, resulting in a first, less than maximum DOC.

FIG. 18B provides an isolated, side view of a representative reduced exposure cutter, such as cutter 328C located in cone region 310. Cutter 328C is shown as being secured in a blade structure 308 at a preselected backrake angle $\theta_{br}$ and exhibits a selected exposed cutter height $H_c$. As can be seen in FIG. 18B, cutter 328C is provided with an optional, peripherally extending chamfered region 321 exhibiting a preselected chamfer width $C_w$. The arrow represents the intended direction of bit rotation when the bit in which the cutter 328C is installed is placed in operation. A gap referenced as $G_1$ can be seen rotationally rearwardly of cutter 328C. Cutter exposure height $H_c$ allows a sufficient amount of cutter 328C to be exposed to allow cutter 328C to engage formation 350 at a particular DOC1, which is well within the maximum DOC that cutter 328C is capable of engaging formation 350, to create a formation cutting 350N at this particular DOC1. Thus, in accordance with the present invention, the WOB now being applied to the bit in which cutter 328C is installed, is at a value less than the design WOB for the instant ROP and the compressive strength of formation 350.

Figure 18C:
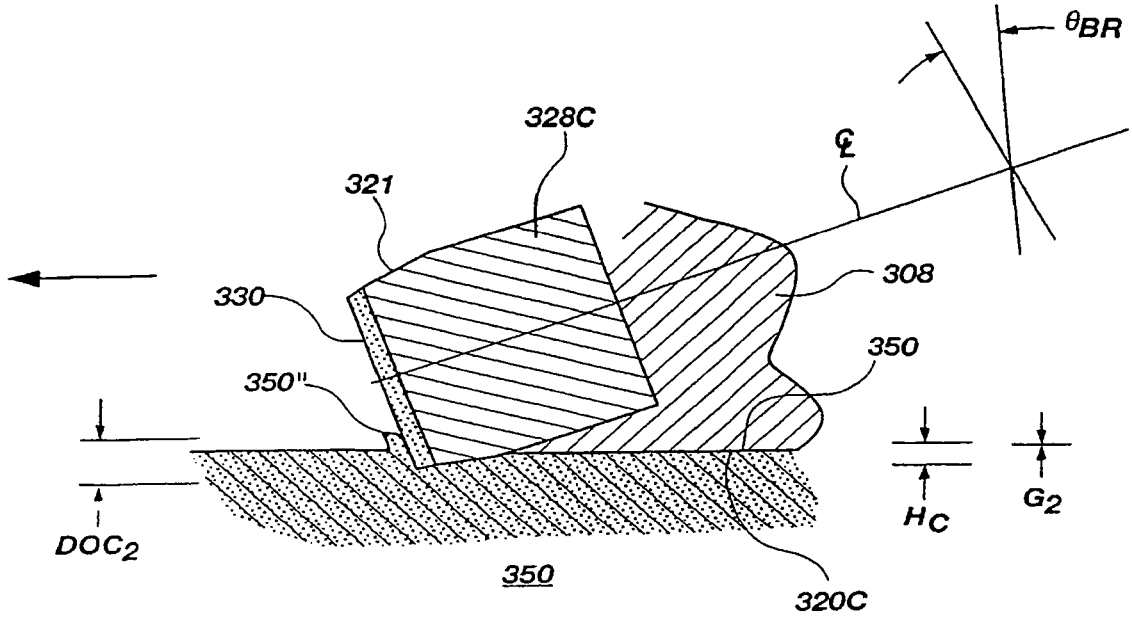
FIG. 18C is a schematic, partial side cross-sectional view of the cutter depicted in FIG. 18A as the cutter engages a relatively soft formation and/or engages a formation at relatively high WOB resulting in a second, essentially maximum DOC.

In contrast to FIG. 18B, FIG. 18C provides essentially the same side view of cutter 328C upon the design WOB for the bit being exceeded for the instant ROP and the compressive strength of formation 350. As can be seen in FIG. 18C, reduced exposure cutter 328C is now engaging formation 350 at a DOC2, which happens to be the maximum DOC that this particular cutter 328C should be allowed to cut. This is because formation 350 is now riding upon outwardly facing bearing surface 320C, which generally surrounds the exposed portion of cutter 328C. That is, gap $G_2$ is essentially nil in that surface 320C and formation 350 are contacting each other and surface 320C is sliding upon formation 350 as the bit to which representative reduced exposure cutter 328C is rotated in the direction of the reference arrow. Thus, especially in the absence of optional wear knots 334 (FIG. 14A), DOC2 is essentially limited to the amount of cutter exposure height at the presently applied WOB in light of the compressive strength of the formation being engaged at the instant ROP. Even if the amount of WOB applied to the bit to which cutter 328C is installed is increased further, DOC2 will not increase as bearing surface 320C, in addition to other bearing surfaces 320C on the bit accommodating reduced exposure of cutter 328C will prevent DOC2 from increasing beyond the maximum amount shown. Thus, bearing surface(s) 320C surrounding at least the exposed portion of cutter 328C, taken collectively with other bearing surfaces 320C, will prevent DOC2 from increasing dimensionally to an extent which could cause an unwanted, potentially bit damaging TOB being generated due to cutter 328C overengaging formation 350. That is, a maximum-sized formation cutting 3500 associated with a reduced exposure cutter engaging the formation at a respective maximum DOC2, taken in combination with other reduced exposure cutters engaging the formation at a respective maximum DOC2, will not generate as taken in combination, a total, excessive amount of TOB which would stall the bit when the design WOB for the bit is met or exceeded for the particular compressive strength of the formation being engaged at the current ROP. Thus, the DOCC aspects of this particular embodiment are achieved by preferably ensuring that there is sufficient area surrounding each reduced exposure cutter 328C, such as representative reduced exposure cutter 328C, so that not only is the DOC2 for this particular cutter 328C, not exceeded, regardless of the WOB being applied, but preferably the DOC of a sufficient number of other cutters provided along the face of a bit encompassing the present invention is limited to an extent which prevents an unwanted, potentially damaging TOB from being generated. Therefore, it is not necessary that each and every cutter provided on a drill bit exhibit a reduced exposure cutter height so as to effectively limit the DOC of each and every cutter, but it is preferred that at least a sufficient quantity of cutters of the total quantity of cutters provided on a bit be provided with at least one of the DOCC features disclosed herein to preclude a bit, and the cutters thereon, from being exposed to a potentially damaging TOB in light of the ROP for the particular formation being drilled. For example, limiting the amount of cutter exposure of each cutter positioned in the cone region of a drill bit may be sufficient to prevent an unwanted amount of TOB should the WOB exceed the design WOB when drilling through a formation of a particular hardness at a particular ROP.

FIGS. 19-22 are graphical portrayals of laboratory test results of four different bladed-style drill bits incorporating PDC cutters on the blades thereof Drill bits labeled "RE-S" and "RE-W" each had selectively reduced cutter exposures in accordance with the present invention as previously described and illustrated in FIGS. 14A-18C. However, drill bit labeled "RE-S" was provided with a cutter profile exhibiting small kerfs and drill bit labeled "RE-W" was provided with a cutter profile exhibiting wide kerfs. The bits having reduced exposure cutters are graphically contrasted with the laboratory test results of a prior art steerable bit labeled "STR" including approximately 0.50 inch diameter cutters with each cutter including a superabrasive table having a peripheral edge chamfer exhibiting a width of approximately 0.050 inch and angled toward the longitudinal axis of the cutter by approximately 45°. Conventional, or standard, general purpose drill bit labeled "STD" included approximately 0.50 inch diameter cutters backraked at approximately 20° and exhibiting chamfers of approximately 0.016 inch in width and angled approximately 45° with respect to the longitudinal axis of the cutter. All bits had a gage diameter of approximately 12.25 inches and were rotated at 120 rpm during testing. With respect to all of the tested bits, the PDC cutters installed in the cone, nose, flank, and shoulder of the bits had cutter backrake angles of approximately 20° and the PDC cutters installed generally within the gage region had a cutter backrake angle of approximately 30°. The cutter exposure heights of the RE-S and RE-W bits were approximately 0.120 inch for the cutters positioned in the cone region, approximately 0.150 inch in the nose region, approximately 0.100 inch in the flank region, approximately 0.063 inch in the shoulder region, and the cutters in the gage region were generally ground flush with the gage for both of these bits embodying the present invention. The PDC cutters of the RE-S and RE-W bits were approximately 0.75 inch in diameter (with the exception of PDC cutters located in the gage region, which were smaller in diameter and ground flush with the gage) and were provided with a chamfer on the peripheral edge of the superabrasive cutting table of the cutter. The chamfers exhibited a width of approximately 0.019 inch and were angled toward the longitudinal axes of the cutters by approximately 45°. The mean kerf width of the RE-S bit was approximately 0.3 inch and the mean kerf width of the RE-W bit was approximately 0.2 inch.

Figure 19:
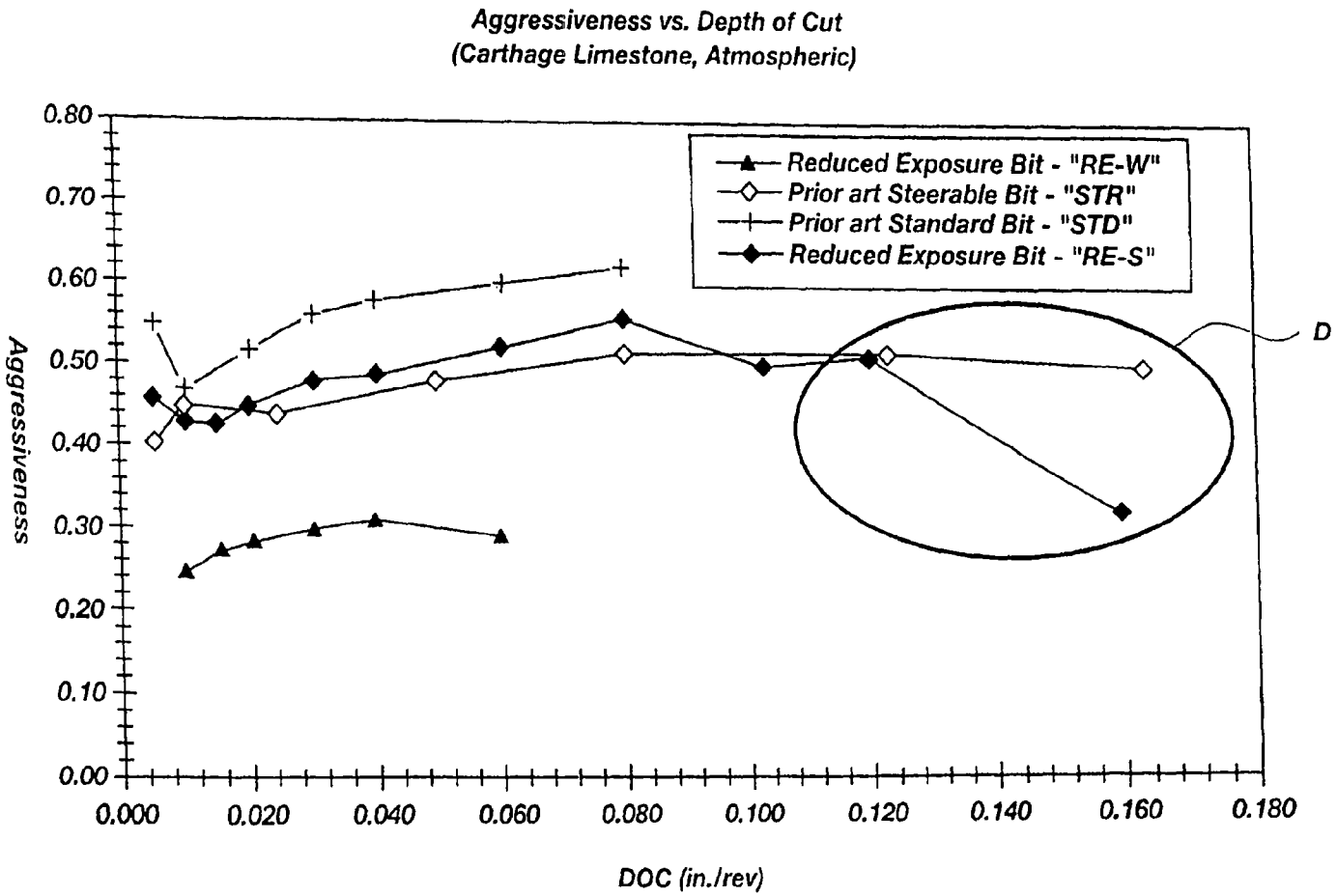
FIG. 19 is a graph depicting laboratory test results of Aggressiveness versus DOC for a representative prior art steerable bit (STR bit), a conventional, or standard, general purpose bit (STD bit) and two exemplary bits embodying the present invention (RE-W and RE-S) as tested in a Carthage limestone formation at atmospheric pressure.

FIG. 19 depicts test results of Aggressiveness (μ) vs. DOC (in/rev) of the four different drill bits. Aggressiveness (μ), which is defined as Torque/(Bit Diameter x Thrust), can be expressed as:

$$\mu=36\text{Torque(ft-lbs)}/\text{WOB(lbs)}\cdot\text{Bit Diameter(inches)}$$

The values of DOC depicted in FIG. 19 represent the DOC measured in inches of penetration per revolution that the test bits made in the test formation of Carthage limestone. The confining pressure of the formation in which the bits were tested was at atmospheric or 0 psig.

Of significance is the encircled region labeled "D" as shown in the graph of FIG. 19. The plot of bit RE-S prior to encircled region D is very similar in slope to prior art steerable bit STR but upon the DOC reaching about 0.120 inch, the respective aggressiveness of the RE-S bit falls rather dramatically compared to the plot of the STR bit proximate and within encircled region D. This is attributable to the bearing surfaces of the RE-S bit taking on and axially dispersing the elevated WOB upon the formation axially underlying the bit associated with the larger DOCs, such as the DOCs exceeding approximately 0.120 inch in accordance with the present invention.

Figure 20:
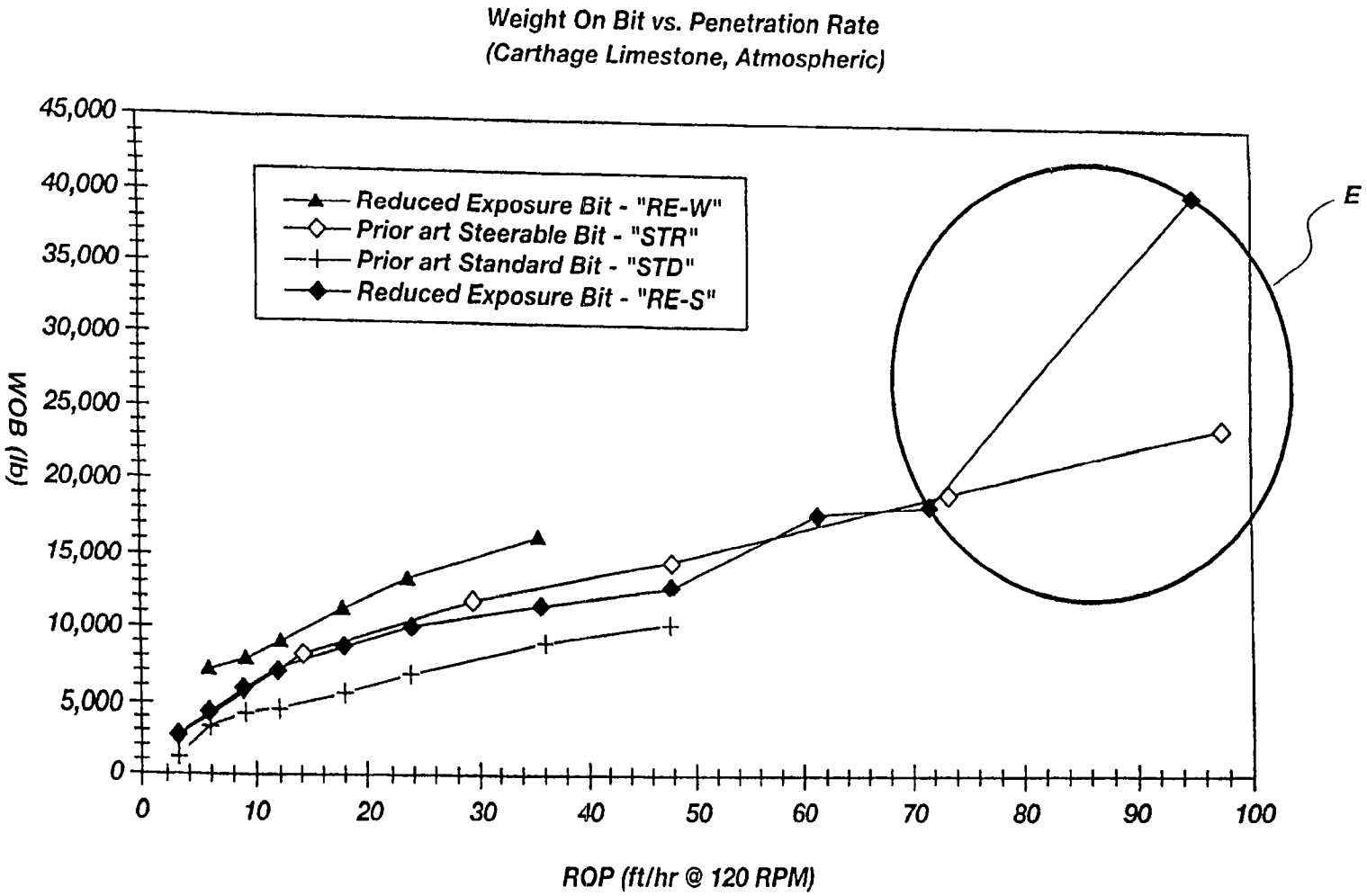
FIG. 20 is a graph depicting laboratory test results of WOB versus ROP for the tested bits.

FIG. 20 graphically portrays the test results with respect to WOB in pounds versus ROP in feet per hour with a drill bit rotation of 120 revolutions per minute. Of general importance in the graph of FIG. 20 is that all of the plots tend to have the same flat curve as WOB and ROP initially increases. Thus, at lower WOBs and lower ROPs, of the RE-S and RE-W bits embodying the present invention exhibit generally the same behavior as the STR and STD bits. However, as WOB was increased, the RE-S bit in particular required an extremely high amount of WOB in order to increase the ROP for the bit due to the bearing surfaces of the bit taking on and dispersing the axial loading of the bit. This is evidenced by the plot of the reduced cutter exposure bit in the vicinity of region labeled "E" of the graph exhibiting a dramatic upward slope. Thus, in order to increase the ROP of the subject inventive bit at ROP values exceeding about 75 ft/hr, a very significant increase of WOB was required for WOB values above approximately 20,000 lbs as the load on the subject bit was successfully dispersed on the formation axially underlying the bit. The fact that a WOB of approximately 40,000 lbs was applied without the RE-S bit stalling provides very strong evidence of the effectiveness of incorporating reduced exposure cutters to modulate and control TOB in accordance with the present invention as will become even more apparent in yet to be discussed FIG. 22.

Figure 21:
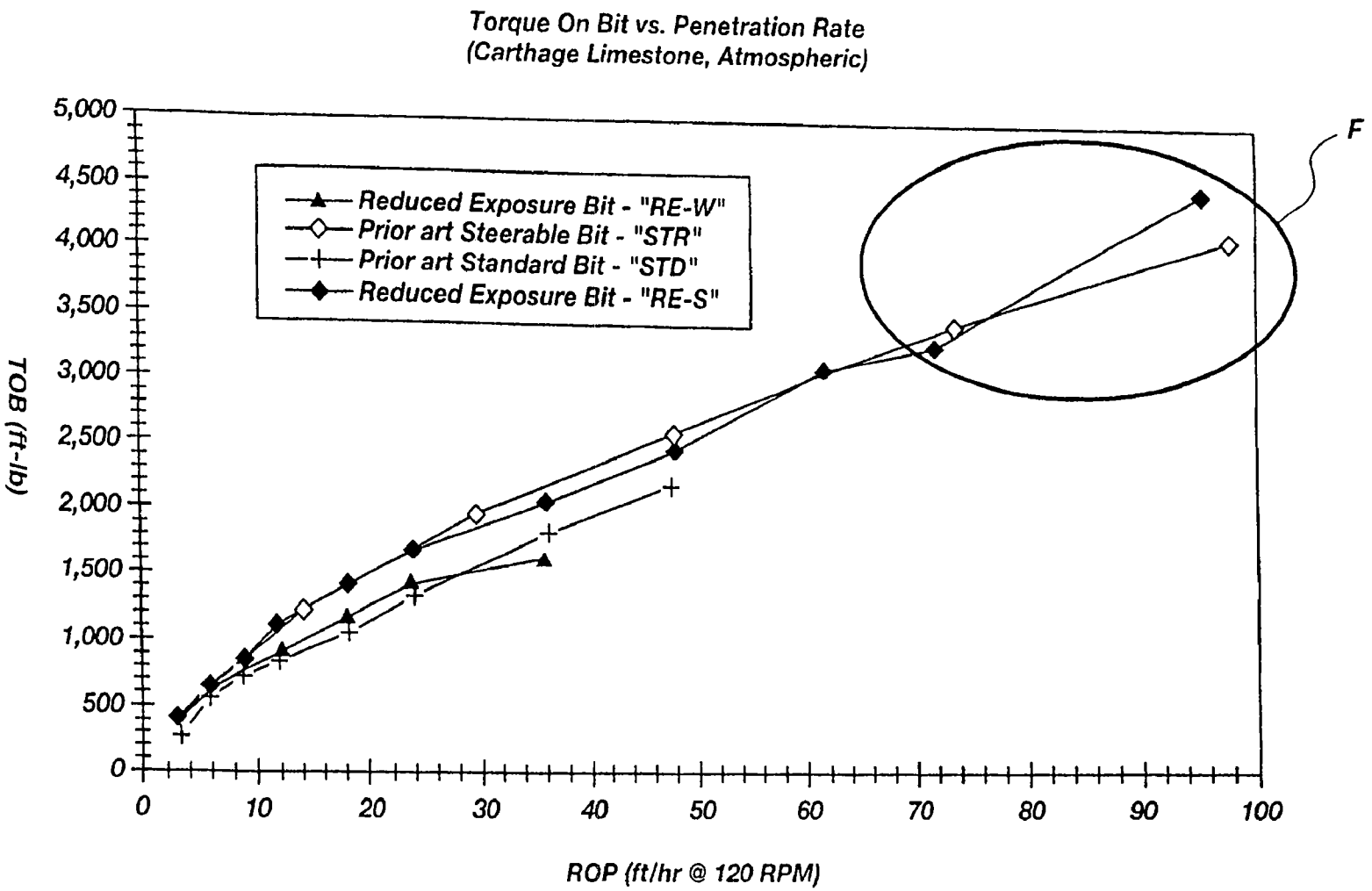
FIG. 21 is a graph depicting laboratory test results of TOB versus ROP for the tested bits.

FIG. 21 is a graphical portrayal of the test results in terms of TOB in the units of pounds-foot versus ROP in the units of feet per hour. As can be seen in the graph of FIG. 21, the various plots of the tested bits generally tracked the same, moderate and linear slope throughout the respective extent of each plot. Even in the region labeled "F" of the graph, where ROP was over 80 ft/hr, the TOB curve of the bit having reduced exposure cutters exhibited only slightly more TOB as compared to the prior art steerable and standard, general purpose bit notwithstanding the corresponding highly elevated WOB being applied to the subject inventive bit as shown in FIG. 20.

Figure 22:
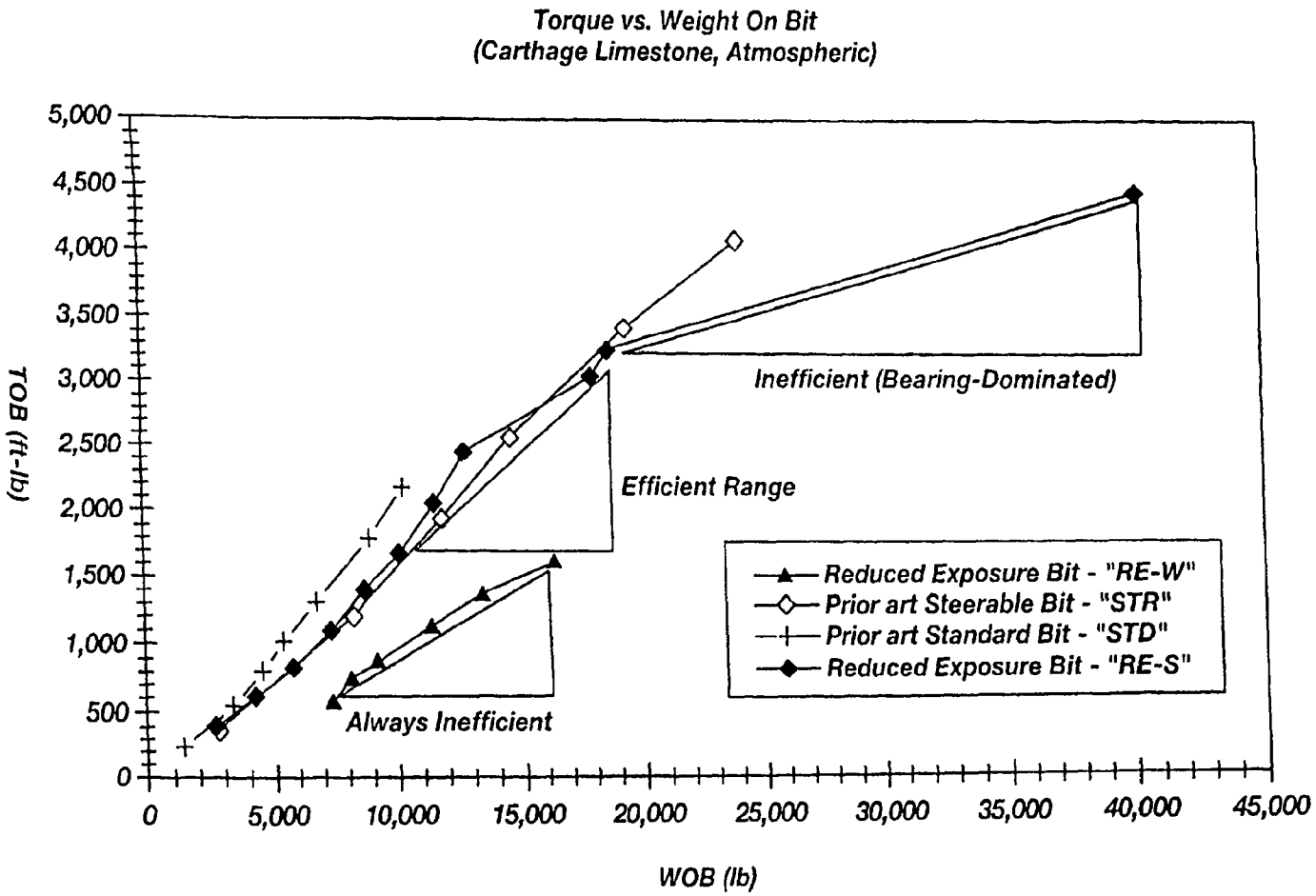
FIG. 22 is a graph depicting laboratory test results of TOB versus WOB for the tested bits.

FIG. 22 is a graphical portrayal of the test results in terms of TOB in the units of foot-pounds versus WOB in the units of pounds. Of particular significance with respect to the graphical data presented in FIG. 22 is that the STD bit provides a high degree of aggressivity at the expense of generating a relatively high amount of TOB at lower WOBs. Thus, if a generally non-steerable, standard bit were to suddenly "break through" a relative hard formation into a relatively soft formation, or if WOB were suddenly increased for some reason, the attendant high TOB generated by the highly aggressive nature of such a conventional bit would potentially stall and/or damage the bit.

The representative prior art steerable bit generally has an efficient TOB/WOB slope at WOBs below approximately 20,000 lbs, but at WOBs exceeding approximately 20,000 lbs, the attendant TOB is unacceptably high and could lead to unwanted bit stalling and/or damage. The RE-W bit incorporating the reduced exposure cutters in accordance with the present invention, which also incorporated a cutter profile having large kerf widths so that the onset of the bearing surfaces of the bit contacting the formation occurs at relatively low values of WOB. However, the bit having such an "always rubbing the formation" characteristic via the bearing surfaces, such as formation facing bearing surfaces 320 of blade structures 308 as previously discussed and illustrated herein, coming into contact and axially dispersing the applied WOB upon the formation at relatively low WOBs, may provide acceptable ROPs in soft formations, but such a bit would lack the amount of aggressivity needed to provide suitable ROPs in harder, firmer formations and thus could be generally considered to exhibit an inefficient TOB versus WOB curve.

The representative RE-S bit incorporating reduced exposure cutters of the present invention and exhibiting relatively small kerf widths effectively delayed the bearing surfaces (for example, including, but not limited to, bearing surface 320 of blade structures 308 as previously discussed and illustrated herein) surrounding the cutters from contacting the formation until relatively higher WOBs were applied to the bit. This particularly desirable characteristic is evidenced by the plot for the RE-S bit at WOB values greater than approximately 20,000 lbs and exhibits a relatively flat and linear slope as the WOB is approximately doubled to 40,000 lbs with the resulting TOB only increasing by about 25% from a value of about 3,250 ft-lbs to a value of approximately 4,500 ft-lbs. Thus, considering the entire plot for the subject inventive bit over the depicted range of WOB, the RE-S bit is aggressive enough to efficiently penetrate firmer formations at a relatively high ROP, but if WOB should be increased, such as by loss of control of the applied WOB, or upon breaking through from a hard formation into a softer formation, the bearing surfaces of the bit contact the formation in accordance with the present invention to limit the DOC of the bit as well as to modulate the resulting TOB so as to prevent stalling of the bit. Because stalling of the bit is prevented, the unwanted occurrence of losing tool face control or worse, damage to the bit, is minimized if not entirely prevented in many situations.

It can now be appreciated that the present invention is particularly suitable for applications involving extended reach or horizontal drilling where control of WOB becomes very problematic due to friction-induced drag on the bit, downhole motor if being utilized, and at least a portion of the drill string, particularly that portion of the drill string within the extended reach, or horizontal, section of the borehole being drilled. In the case of conventional, general purpose fixed cutter bits, or even when using prior art bits designed to have enhanced steerability, which exhibit high efficiency, that is, the ability to provide a high ROP at a relatively low WOB, the bit will be especially prone to large magnitudes of WOB fluctuation, which can vary from 10 to 20 klbs (10,000 to 20,000 pounds) or more, as the bit lurches forward after overcoming a particularly troublesome amount of frictional drag. The accompanying spikes in TOB resulting from the sudden increase in WOB may in many cases be enough to stall a downhole motor or damage a high efficient drill bit and or attached drill string when using a conventional drill string driven by a less sophisticated conventional drilling rig. If a bit exhibiting a low efficiency is used, that is, a bit that requires a relatively high WOB is applied to render a suitable ROP, the bit may not be able to provide a fast enough ROP when drilling harder, firmer formations. Therefore, when practicing the present invention of providing a bit having a limited amount of cutter exposure above the surrounding bearing surface of the bit and selecting a cutter profile which will provide a suitable kerf width and kerf height, a bit embodying the present invention will optimally have a high enough efficiency to drill hard formations at low depths-of-cut, but exhibit a torque ceiling that will not be exceeded in soft formations when WOB surges.

While the present invention has been described herein with respect to certain preferred embodiments, those of ordinary skill in the art will recognize and appreciate that it is not so limited and many additions, deletions, and modifications to the preferred embodiments may be made without departing from the scope of the invention as claimed. In addition, features from one embodiment may be combined with features of another embodiment while still being encompassed within the scope of the invention. Further, the invention has utility in both full bore bits and core bits, and with different and various bit profiles as well as cutter types, configurations and mounting approaches.

What is claimed is:

1. A rotary drill bit for subterranean drilling, comprising:

a bit body including a face comprising at least a cone region proximate a centerline of the bit body and a nose region radially outward from the cone region, the face having a plurality of blades thereover, blades of the plurality extending generally radially outward toward a gage region, at least one blade of the plurality having a radially inner end proximate the centerline; and superabrasive cutters disposed on each blade of the plurality, wherein superabrasive cutters within the cone region generally exhibit a reduced exposure above a blade bearing surface on a blade on which the superabrasive cutters within the cone region are respectively disposed, in comparison to an exposure above a blade surface generally exhibited by superabrasive cutters within the nose region.

2. The rotary drill bit of claim 1, wherein the face further comprises a shoulder region, wherein superabrasive cutters within the shoulder region generally exhibit a greater exposure above a blade surface in comparison to an exposure above a blade surface generally exhibited by the superabrasive cutters within the nose region.

3. The rotary drill bit of claim 2, wherein an exposure above a blade surface generally exhibited by the superabrasive cutters within the shoulder region decreases toward the gage region.

4. The rotary drill bit of claim 1, wherein at least one blade bearing surface within the cone region generally surrounds an exposed portion of at least one of the superabrasive cutters.

5. The rotary drill bit of claim 1, wherein at least one of the superabrasive cutters within the cone region has an associated blade bearing surface at least one of laterally adjacent and trailingly adjacent, taken in a direction of intended bit rotation.

6. A rotary drill bit for subterranean drilling, comprising:

a bit body including a face comprising at least a cone region proximate a centerline of the bit body and a nose region radially outward from the cone region, the face having a plurality of blades thereover, blades of the plurality extending generally radially outward toward a gage region, at least one blade of the plurality having a radially inner end within the cone region; and superabrasive cutters disposed on each blade of the plurality, wherein superabrasive cutters within the cone region generally exhibit a reduced exposure above a blade bearing surface adjacent thereto on a blade on which the superabrasive cutters within the cone region are respectively disposed, in comparison to an exposure above a blade surface generally exhibited by superabrasive cutters within the nose region.

7. The rotary drill bit of claim 6, wherein the face further comprises a shoulder region, wherein superabrasive cutters within the shoulder region generally exhibit a greater exposure above a blade surface in comparison to an exposure above a blade surface generally exhibited by superabrasive cutters within the nose region.

8. The rotary drill bit of claim 7, wherein an exposure above a blade surface generally exhibited by superabrasive cutters within the shoulder region decreases toward the gage region.

9. The rotary drill bit of claim 6, wherein at least one blade bearing surface within the cone region generally surrounds an exposed portion of at least one of the superabrasive cutters.

10. The rotary drill bit of claim 6, wherein at least one of the superabrasive cutters within the cone region has an adjacent blade bearing surface at least one of laterally adjacent and trailingly adjacent, taken in a direction of intended bit rotation.

11. A rotary drill bit for subterranean drilling, comprising:

a bit body including a face comprising at least a cone region proximate a centerline of the bit body, a nose region radially outward of the cone region, and a gage region;

superabrasive cutters disposed on the face; and at least one bearing surface on the face within the cone region effectively limiting a general exposure of superabrasive cutters within the cone region to less than a general exposure of superabrasive cutters within the nose region;

wherein, upon rotation of the rotary drill bit under weight on bit (WOB) against a subterranean formation, the rotary drill bit exhibits a markedly reduced aggressiveness upon reaching a depth of cut substantially equal to the general exposure of superabrasive cutters in the cone region as limited by contact of the at least one bearing surface within the cone region with a face of the subterranean formation.

12. A rotary drill bit for subterranean drilling, comprising:

a bit body including a face comprising at least a cone region proximate a centerline of the bit body, a nose region radially outward of the cone region, and a gage region;

superabrasive cutters disposed on the face; and at least one bearing surface on the face within the cone region;

wherein, upon rotation of the rotary drill bit under weight on bit (WOB) against a subterranean formation and engagement of the superabrasive cutters therewith, the rotary drill bit exhibits a first rate of torque increase responsive to a rate of weight on bit (WOB) increase and, upon and responsive to contact of the at least one bearing surface within the cone region with a face of the subterranean formation, exhibits a second, substantially reduced rate of torque increase responsive to a rate of increase of weight on bit (WOB).

13. The rotary drill bit of claim 12, wherein a rate of penetration (ROP) of the rotary drill bit does not substantially increase upon and after contact of the at least one bearing surface within the cone region with the face of the subterranean formation.

14. A rotary drill bit for subterranean drilling, comprising:

a bit body including a face comprising at least a cone region proximate a centerline of the bit body, a nose region radially outward of the cone region, and a gage region;

superabrasive cutters disposed on the face; and at least one bearing surface on the face within the cone region;

wherein, upon rotation of the rotary drill bit under weight on bit (WOB) against a subterranean formation and engagement of the superabrasive cutters therewith, the rotary drill bit exhibits a first rate of penetration (ROP) increase responsive to a rate of weight on bit (WOB) increase and, upon and responsive to contact of the at least one bearing surface within the cone region with a face of the subterranean formation, exhibits a second, proportionately lesser rate of penetration (ROP) increase responsive to a further increase of weight on bit (WOB).

15. A rotary drill bit for subterranean drilling, comprising:

a bit body including a face comprising at least a cone region and a nose region radially outward from the cone region, the face having a plurality of blades thereover, blades of the plurality extending generally radially outward toward a gage region, at least one blade of the plurality having a radially inner end within the cone region; and superabrasive cutters disposed on each blade of the plurality, wherein at least a majority of superabrasive cutters within the cone region generally exhibit an exposure of no more than about one-half of a cutter diameter above a blade bearing surface associated therewith, and superabrasive cutters within the nose region generally exhibit a greater exposure above a blade surface associated therewith.

16. The rotary drill bit of claim 15, wherein the superabrasive cutters within the cone region generally exhibit an exposure of no more than about one-quarter of a cutter diameter above the blade bearing surface associated therewith.

17. The rotary drill bit of claim 15, wherein the superabrasive cutters within the cone region generally exhibit an exposure of about one-sixth of a cutter diameter above the blade bearing surface associated therewith.

18. The rotary drill bit of claim 15, wherein at least one of the superabrasive cutters within the cone region has an associated blade bearing surface at least one of laterally adjacent and trailingly adjacent, taken in a direction of intended bit rotation.

19. A rotary drill bit for subterranean drilling, comprising:

a bit body including a face comprising at least a cone and a nose region radially outward from the cone region, the face having a plurality of blades thereover, the plurality of blades extending generally radially outward toward a gage region, at least one blade of the plurality having a radially inner end within the cone region; and superabrasive cutters disposed on each blade of the plurality, wherein superabrasive cutters within the cone region exhibit, on average, an exposure of no more than about one-half of a cutter diameter above an adjacent blade bearing surface on the same blade, and superabrasive cutters within the nose region exhibit, on average, a greater exposure above an adjacent blade surface on the same blade.

20. The rotary drill bit of claim 19, wherein the superabrasive cutters within the cone region generally exhibit an exposure of no more than about one-quarter of a cutter diameter above the adjacent blade bearing surface on the same blade.

21. The rotary drill bit of claim 19, wherein the superabrasive cutters within the cone region generally exhibit an exposure of about one-sixth of a cutter diameter above the adjacent blade bearing surface on the same blade.

22. The rotary drill bit of claim 19, wherein at least one of the superabrasive cutters within the cone region has an adjacent blade bearing surface at least one of laterally abutting and trailingly abutting, taken in a direction of intended bit rotation.

23. A rotary drill bit for subterranean drilling, comprising:

a bit body including a face comprising at least a cone region and a nose region radially outward from the cone region, the face having a plurality of blades thereover, the blades of the plurality extending generally radially outward toward a gage region, at least one blade of the plurality having a portion within the cone region; and superabrasive cutters disposed on each blade of the plurality, wherein superabrasive cutters on the portion of the at least one blade within the cone region exhibit, on average, a reduced exposure above a blade bearing surface on the at least one blade, in comparison to an exposure above a blade surface exhibited, on average, by superabrasive cutters within the nose region and radially inward of the gage region.

24. A rotary drill bit for subterranean drilling, comprising:

a bit body including a face comprising at least a cone region and a nose region radially outward from the cone region, the face having a plurality of blades thereover, blades of the plurality extending generally radially outward toward a gage region, at least one blade of the plurality having a portion within the cone region; and superabrasive cutters disposed on each blade of the plurality, wherein superabrasive cutters on the portion of the at least one blade within the cone region exhibit an average exposure above a blade bearing surface on the at least one blade less than an average exposure above a blade surface exhibited by superabrasive cutters within the nose region and radially inward of the gage region.

* * * * *